US005362943A

United States Patent [19]

Sakata

[11] Patent Number: 5,362,943

[45] Date of Patent: Nov. 8, 1994

[54] FIXING DEVICE AND HEAT ROLLER THEREFOR

[75] Inventor: Yoshio Sakata, Kanagawa, Japan

[73] Assignee: Kanegafuchi Kagaku Kogyo Kabushiki Kaisha, Osaka, Japan

[21] Appl. No.: 51,997

[22] Filed: Apr. 26, 1993

Related U.S. Application Data

[62] Division of Ser. No. 857,231, Mar. 25, 1992, Pat. No. 5,286,950.

[30] Foreign Application Priority Data

| | | | |
|---|---|---|---|
| Mar. 26, 1991 | [JP] | Japan | 3-026703 |
| Mar. 26, 1991 | [JP] | Japan | 3-026704 |
| Mar. 26, 1991 | [JP] | Japan | 3-087743 |
| Aug. 20, 1991 | [JP] | Japan | 3-073816 |
| Aug. 20, 1991 | [JP] | Japan | 3-073817 |
| Aug. 20, 1991 | [JP] | Japan | 3-0233988 |
| Aug. 23, 1991 | [JP] | Japan | 3-074779 |

[51] Int. Cl.[5] ..... B21B 27/06; H05B 3/02

[52] U.S. Cl. ..... 219/216; 219/469; 355/289

[58] Field of Search ..... 219/216, 469, 470, 471; 355/282, 285, 289, 290, 295; 428/448, 451; 492/46, 53

[56] References Cited

U.S. PATENT DOCUMENTS

| | | | |
|---|---|---|---|
| 1,852,190 | 4/1932 | Roe | 439/482 |
| 3,683,305 | 8/1972 | Gray . | |
| 4,150,181 | 4/1979 | Smith . | |
| 4,724,305 | 2/1988 | Iimura | 219/469 |
| 4,810,858 | 3/1989 | Urban et al. . | |
| 4,820,904 | 4/1989 | Urban | 219/216 |
| 4,904,213 | 2/1990 | Hock | 439/482 |
| 4,910,559 | 3/1990 | Kuge et al. | 219/469 |

FOREIGN PATENT DOCUMENTS

| | | | |
|---|---|---|---|
| 0071969 | 2/1983 | European Pat. Off. . | |
| 2337751 | 1/1975 | Germany . | |
| 53-20934 | 2/1978 | Japan . | |
| 56-48664 | 5/1981 | Japan | 219/216 |
| 56-109381 | 8/1981 | Japan | 219/216 |
| 59-33474 | 2/1984 | Japan . | |
| 59-87476 | 5/1984 | Japan | 355/289 |
| 61-84670 | 4/1986 | Japan | 355/289 |
| 61-158361 | 7/1986 | Japan | 355/289 |
| 61-132866 | 8/1986 | Japan . | |
| 2-71287 | 3/1990 | Japan | 219/469 |
| 3-73816 | 8/1991 | Japan . | |
| 3-73817 | 8/1991 | Japan . | |
| 3-74779 | 8/1991 | Japan . | |

OTHER PUBLICATIONS

IBM Technical Disclosure Bulletin, vol. 25, No. 3B, Aug. 1982; New York US, pp. 1365–1367.

Patent Abstracts of Japan, vol. 008, No. 014 (P-249) 21 Jan. 1984 & JP-A-58 173 772 (Hitachi Seisakusho KK) 12 Oct. 1983 (Abstract).

Patent Abstract of Japan, vol. 007, No. 002 (P-166) 7 Jan. 1983 & JP-A-57 161 767 (Konishiroku Shashin Kogyo KK) 5 Oct. 1982 (Abstract).

Patent Abstracts of Japan, vol. 008, No. 242 (P-311) 7 Nov. 1984 & JP-A-59 116 775 (Ricoh KK) 5 Jul. 1984 (Abstract).

Patent Abstracts of Japan, vol. 008, No. 286 (P-324) 27 Dec. 1984 & JP-A-59 149 385 (Hitachi Kinozoku KK) 27 Aug. 1984 (Abstract).

Patent Abstracts of Japan, vol. 008, No. 219 (P-306) 5 Oct. 1984 & JP-A-59 102 268 (Hitachi Kinzoku KK) 13 Jun. 1984 (Abstract).

(List continued on next page.)

*Primary Examiner*—Geoffrey S. Evans

*Attorney, Agent, or Firm*—Armstrong, Westerman, Hattori, McLeland & Naughton

[57] ABSTRACT

A heat roller having a resin layer for adhesion provided on the outer surface of a roller body, containing a silicone resin material of good thermal conductivity which is in the form of an oil in a temperature range of −50 to 150 degrees Celsius and is thermosettable above 150 degrees Celsius, which is interposed between the roller body and the resin layer by coating.

3 Claims, 43 Drawing Sheets

OTHER PUBLICATIONS

Patent Abstracts of Japan, vol. 012, No. 284 (P-740) 4 Aug. 1988 & JP-A-63 063 074 (Hitachi Metals Ltd.) 19 Mar. 1988 (Abstract).

Patent Abstracts of Japan, vol. 008, 219 (P-306) 5 Oct. 1984 & JP-A-59 102 267 (Hitachi Kinzoku KK) 13 Jun. 1984 (Abstract).

Patent Abstracts of Japan, vol. 010, No. 106 (P-449) 22 Apr. 1986 & JP-A-60 238 879 (Matsushita Denki Sangyo KK) 20 Jan. 1986 (Abstract).

Patent Abstracts of Japan, vol. 010, No. 157 (P-464) 6 Jun. 1986 & JP-A-61 011 773 (Matsushita Denki Sangyo KK) 20 Jan. 1986 (Abstract).

Patent Abstracts of Japan, vol. 012, No. 343 (P-728) 9 Jul. 1988 & JP-A-63 036 284 (Showa Electric Wire & Cable Co. Ltd.) 16 Feb. 1988 (Abstract).

Patent Abstracts of Japan, vol. 014, No. 264 (P-1057) 7 Jun. 1990 & JP-A-02 073 281 (Hokushin Ind Inc.) 13 Mar. 1990.

Patent Abstracts of Japan, vol. 010, No. 038 (P-428) 14 Feb. 1986 & JP-A-60 185 911 (Dainichi Nippon Densen KK; Others: 01) 21 Sep. 1985 (Abstract).

Patent Abstracts of Japan, vol. 001, No. 040 (P-544) 5 May 1987 & JP-A-61 209 472 (Fuji Xerox Co. Ltd.) 17 Sep. 1986 (Abstract).

Patent Abstracts of Japan, vol. 011, No. 008 (C—396) 9 Jan. 1987 & JP-A-61 185 527 (Toray Silicone Co. Ltd.) 19 Aug. 1986 (Abstract).

Patent Abstracts of Japan, vol. 010, No. 140 (P-458) 23 May 1986 & JP-A-60 260 077 (Sumitomo Kenki Kogyo KK) 23 Dec. 1985 (Abstract).

Patent Abstracts of Japan, vol. 008, No. 075 (P-266) 7 Apr. 1984 & JP-A-58 220 165 (Ricoh KK) 21 Dec. 1983 (Abstract).

Patent Abstracts of Japan, vol. 13, No. 554 (P-973) 11 Dec 1989 & JP-A-01 231 077 (Hitachi) 14 Sep. 1989 (Abstract).

Patent Abstracts of Japan, vol. 9, No. 273 (P-401) 30 Oct. 1985 & JP-A-60 118 868 (Ricoh) 26 Jun. 1985 (Abstract).

Patent Abstracts of Japan, vol. 6, No. 85 (P-117) (962) 22 May 1982 & JP-A-57 020 771 (Tokyo Silicone) 3 Feb. 1982 (Abstract).

Patent Abstracts of Japan, vol. 8, No. 259 (P-317) (1696) 28 Nov. 1984 & JP-A-59 128 572 (Hitachi Kinzoku) 25 Jul. 1984 (Abstract).

FIXING DEVICE AND HEAT ROLLER THEREFOR

This is a division of application Ser. No. 07/857,231 filed Mar. 25, 1992, now U.S. Pat. No. 5,286,950.

BACKGROUND OF THE INVENTION

1. Field of the Invention

The present invention relates to a fixing device provided in an electrostatic recording system, e.g., a copying machine, a facsimile, a printer, etc., to fix a toner image transferred to a sheet of recording paper, and also relates to a heat roller for use in the fixing device. More particularly, the present invention relates to an improvement in the heat roller.

2. Description of the Prior Art

In an electrostatic recording system, for example, a copying machine, a facsimile, a printer, etc., a toner image transferred to a sheet of recording paper from a photosensitive drum of a developing device must be heat-fixed to the recording paper by allowing the toner particles to catch on the fibers of the recording paper. A fixing device used for this purpose comprises a heat roller 100 having a heat source and a press roller 200 coated with a heat-resistant resin material, as shown in FIG. 53. The heat roller 100 and the press roller 200 are disposed in opposed contact with each other. A sheet of recording paper 300 having a toner image transferred thereto is passed through the area between the heat roller 100 and the press roller 200, thereby fixing the toner image.

The most common type of heat roller is the indirect heating type in which a heat source, for example, an infrared lamp, a halogen lamp, etc., is incorporated in a metallic sleeve having good thermal conductivity. However, the indirect heating type heat roller has the problem that it needs a costly thin tube-shaped lamp and a thick-walled metallic sleeve having a surface smoothed with high accuracy, resulting in an extremely high overall cost. In addition, because of the indirect heating this type of heat roller cannot rise in temperature rapidly. To solve these problems, direct heating type heat rollers have spread recently in place of the indirect heating type.

FIG. 54 shows a typical direct heating type heat roller that comprises a heating member 101 which is a cylindrical insulator coated at its surface with a heating layer of an electrically conductive material, and a pair of strip-shaped sliding pieces 102 which are in contact with the outer peripheral surfaces of both end portions of the heating member 101, thereby supplying electric power to the rotating heating member 101 through the sliding pieces 102. FIG. 55 shows another typical direct heating type heat roller that comprises a cylindrical heating member 101 which is formed from an electrically conductive ceramic material in its entirety, and a pair of bearings 400 which are fitted on the outer peripheries of both end portions of the heating member 101, so that the heating member 101 is rotatably supported by the bearings 400 and, at the same time, electric power is supplied to the two end portions of the heating member 101 through the bearings 400.

However, this type of heat roller has various problems to be solved.

First, the heat roller that employs the sliding pieces 102 to supply electric power, shown in FIG. 54, has tile problem that the surface of the heating member 101 is worn away by the sliding pieces 102 and sparks are given off at the area of contact between the heating member 101 and the sliding pieces 102. The heat roller in which electric power is supplied through the bearings 400, shown in FIG. 55, suffers from the problem that an electric conduction failure may occur because electricity flows through balls interposed in the area between outer and inner rings and the contact between the balls and the outer and inner rings is not always perfect.

In addition, since the surface of the heating member 101 is heated to an exceedingly high temperature, the bearings 400 that are in contact with the heating member 101 are exposed to the high temperature, as a matter of course. Under such conditions, the bearings 400 wear at a remarkably high rate, and thermal expansion of the bearings 400 occurs. Accordingly, the rate of incidence of conduction failure is extremely high in the present state of art.

There are other forms of power supply in the direct heating type heat roller, in which electric power is supplied through metal terminals that are secured to both end portions of a cylindrical heating member by silver soldering or through metal terminals that are closely fitted in respective hollow portions at both ends of a cylindrical heating portion. However, the power supply method that uses metal terminals secured by silver soldering has the problems that the soldered portions cannot endure mechanical vibration that accompanies the rotational motion of the heat roller and that the soldered portions may separate during the process of use because of the difference in the coefficient of thermal expansion between the silver soldering material and the ceramic heating member. The method in which power is supplied through metal terminals that are closely fitted into respective hollow portions at both axial ends of a cylindrical heating portion has likelihood that since the metal terminals have a high coefficient of thermal expansion, when thermally expanded, the metal terminals may destroy the ceramic heating member. In addition, a feed brush for supplying electric power to each conducting terminal must be provided in sliding electric contact with the free end of the conducting terminal, that is, with the end of the conducting terminal on the side thereof which is opposite to the end thereof that is fitted into the hollow end portion of the heating member. It is therefore necessary to control the positional relationship between the heat roller and the feed brushes extremely strictly. In addition, the operation of assembling the heat roller and the feed brushes is difficult, so that the assembling efficiency is low.

Thus, the conventional heat rollers involve problems in terms of the structure for rotatably supporting the end portions of the heat roller heated to a high temperature and of the method of supplying electric power to the heat roller. In view of these circumstances, there has been a demand for a technique that enables good electric contact to be surely made between the feed brushes and the conducting terminals, which serve as feed means, so that electric power can be supplied to the heating portion effectively and reliably, and that also permits minimization of the heat load applied to the bearing portions.

There has heretofore been another problem in terms of the control of the surface temperature of the heat roller. That is, it is necessary in order to ensure effective fixing of the developer to maintain the heat roller at a predetermined temperature. In addition, an excessive rise in temperature should be avoided from the viewpoint of preventing a fire or other similar problem. As a means of preventing an excessive rise in temperature of the heat roller, there has heretofore been only one method wherein temperature sensors of good response are disposed in close proximity to both axial ends of the heat roller, and signals output from the temperature sensors are processed in an electric circuit provided separately, thereby limiting the electric power supplied to the heat roller or cutting off the power supply. However, such an excessive temperature rise preventing means uses costly temperature sensors and needs additionally an electric circuit for monitoring signals output from the temperature sensors and hence it is costly, so that the use of the excessive temperature rise preventing means causes a rise in the overall cost of the apparatus and also hinders realization of a reduction in the overall size of the apparatus. Under these circumstances, there has been a demand for an excessive temperature rise preventing means that is simple in structure and inexpensive and that needs an extremely small space for installation or requires no installation space.

We have already discussed problems which are experienced when electric power is supplied through bearings that hold a heating member. Meantime, even in a case where bearings do not serve as feed means, there are some problems attributable to the use of bearings. More specifically, bearings are arranged such that a plurality of steel balls are retained in the area between inner and outer rings, and if a direct heating type heat roller is supported with such bearings, since the bearings rotate in direct contact with the heat roller surface that reaches a high temperature of 200° C. to 300° C. they deteriorate at a remarkably high rate and the toughness of the bearing material lowers rapidly, resulting in an interference with the rotational function of the bearings during the process of use over a long time and hence a failure to obtain the desired rotational operation. heat-resistant grease that is employed for smoothing the rotation of bearings serves to deter deterioration of the bearings, but it volatilizes at a remarkably high rate under high-temperature conditions. Accordingly, the use of such heat-resistant grease cannot solve the basic problem of the deterioration of bearings. Incidentally, there are bearings called "oil retaining bearings", although such bearings have not yet had the experience of being used as means for supporting a heat roller. Oil retaining bearings, which comprise an annular sintered metal member that is impregnated with a lubricating oil, can be used for a long time without lubrication under ordinary temperature conditions. However, if oil retaining bearings are used as means for supporting a heat roller, since the heat roller is exposed to high temperature, the oil volatilizes at a remarkably high rate, so that the oil retaining bearings are expected to lose their bearing function in an early stage of use. Thus, oil retaining bearings cannot practically be used as heat roller supporting means. Under these circumstances, there has been a demand for a bearing structure which has substantially no deterioration during the process of use and ensures a smooth rotation of a heat roller even after a long-term service and which is simple in structure and inexpensive.

In addition, it is preferable that the temperature of the heat roller surface should be uniform over the entirety thereof, but it has been difficult for the conventional heat rollers to realize a uniform temperature distribution over the heat roller surface. If the surface temperature is uneven in the axial direction, the toner fixing condition also becomes uneven, causing a fixing failure. However, since the axial end faces of the heat roller are in contact with the ambient air and the axial end portions of the heat roller conduct heat to the bearing members, the temperature lowers at the end portions of the heat rollers. Referring to FIG. 56, which shows a temperature distribution in the axial direction of the heat roller surface, the temperature curve is flat and maintains a substantially constant value in the range L at the center of the heating member 101, whereas in the range $L_0$ near each axial end portion the temperature curve lowers gradually. Thus, the temperature curve has descending regions in correspondence with the two axial end portions of the heat roller. The end portions of the heat roller corresponding to the descending regions have a marked lowering in temperature and therefore cannot be used as fixing regions, so that only the portion of the heat roller which has a flat temperature curve, exclusive of the end portions corresponding to the descending regions, can be used for the fixing process (the portion being hereinafter referred to as "usable region L") . However, in the conventional heat rollers, the ratio of the length of the descending regions to the overall length of the heating portion is relatively high, and it is therefore necessary in order to ensure a predetermined usable region to employ a heat roller having a heating portion considerably longer than the usable region, which is an obstacle to the realization of a reduction in the overall size and a lowering in the cost of the apparatus. In view of these circumstances, there has been a demand for a technique which enables minimization of the descending regions in the temperature curve and permits enlargement of the usable region.

In addition, a typical conventional fixing device comprises a heat roller 100 and a press roller 200, as shown in FIG. 57. The press roller 200 comprises a metallic core 201 and a thick-walled resin layer 202 formed on the outer surface of the core 201 by using a heat-resistant resin material. The resin layer 202 may be formed from a silicone resin material or a silicone foam in its entirety, or it may be formed by coating a silicone resin material on the outer surface of a silicone foam. However, such a press roller needs to form a resin layer over the surface of a metallic core with a uniform thickness in both the axial and circumferential directions and hence requires a high processing cost. In addition, since the press roller also needs a mechanism for rotatably supporting the core, the apparatus is complicated, and the assembling cost is high. Since the press roller and the mechanism for rotatably supporting it have certain sizes, the reduction in the size of the fixing device is limited. In addition, a fixing device comprising a heat roller and a press roller needs additionally a paper guide 500 for directing paper to the area between the two rollers, and the presence of this paper guide 500 is an obstacle to achievement of a reduction in the overall size of the fixing device and other peripheral devices. Under these circumstances, there has been a demand for a fixing device structure which enables a lowering in the cost and a reduction in the size of the fixing device, and which also eliminates the need for the paper guide 500.

FIG. 58 shows another conventional heat roller 100 in which the outer surface of a roller body 103 is coated with a resin layer 104 for adhesion, e.g., silicone rubber, for the purpose of improving the adhesion to recording paper and thereby enhancing the heat fixing effectiveness. This prior art also has problems to be solved.

It is extremely essential for heat rollers to ensure a uniform surface temperature and improve the heating response. More specifically, if the surface temperature is not uniform, fixing of toner to recording paper becomes uneven, and if the heating response is low, a relatively long time is needed to raise the temperature, so that it takes a long time to warm up the heat roller, and the heat roller requires a long time to return to a predetermined temperature after the recording paper has passed therethrough. Accordingly, it is impossible to speed up the fixing process. For this reason, it is desirable to coat the resin layer for adhesion such that it contacts the roller body uniformly over the entire surface. In actual practice, however, there are irregularities in the surface of the roller body 103 due to the limitation of the surface machining technique, and minute air gaps 105 are formed between the roller body 103 and the resin layer 104, as shown in FIG. 59. The minute air gaps 105 obstruct the transmission of heat from the roller body 103 to the surface of the resin layer 104 and hence hinder uniform heating of the heat roller surface and improvement of the heating response. This tendency is particularly remarkable in the case where the roller body is a heating member made of an electrically conductive ceramic material.

In view of these problems, it has been a conventional practice to set the target heating temperature for the whole heat roller at a level a little higher than the lowest temperature necessary for fusing the toner, thereby enabling the toner to be effectively fused even at low-temperature portions which are locally present on the heat roller surface. However, if the heat roller heating temperature is set at a relatively high level, the electric power is wasted, and the deterioration of the heat roller is accelerated. In addition, it is necessary to employ costly peripheral parts which can cope with high-temperature conditions. The most significant problem is that since the heat roller is heated to an excessively high temperature, the toner becomes likely to weld to the heat roller surface, so that a fixing failure is likely to occur. If a toner removing device that is placed in sliding contact with the heat roller surface is provided in order to prevent such a problem, the lifetime of the heat roller is shortened owing to friction occurring between the heat roller and the toner removing device. Under these circumstances, there has been a demand for a heat roller which is designed so that the heat roller surface can be heated uniformly and the heating response is improved, thereby enabling an excellent fixing condition to be realized without inviting a waste of electric power and a rise in the cost of the peripheral parts.

BRIEF SUMMARY OF THE INVENTION

It is an object of the first invention to provide a heat roller for use in a fixing device, which is designed so that effective electric contact is surely made between the heat roller and conducting terminals serving as feed means, thereby good electric power to be reliably supplied to a heating portion, and so that the heat load to bearing portions is reduced to make it possible to improve the durability of the bearing portions and increase the degree of freedom with which a material for the bearing portions can be selected.

The first invention is characterized in that the heating portion and the shaft portions are integrally molded from the same material in the form of a molded member at least both end portions of which are hollow and that the inner surfaces of the hollow portions at both ends of the molded member are partly or entirely coated with a soft electrically conductive metal by means, for example, of vapor deposition, plating, or coating.

It is preferable that the resistance between the axial ends of the molded member before it is coated with an electrically conductive metal should be set in the range of 5Ω to 100Ω. It is also preferable that the outer end of at least one of the shaft portions should have a cross-sectional configuration containing a straight or curved portion, exclusive of a circular arc, in a part thereof or in its entirety.

The heat roller of the first invention is arranged such that bearings are fitted on the respective outer peripheries of the shaft portions at both ends of the heat roller to support it rotatably, and conducting terminals serving as feed means are fitted into the respective hollow portions at both axial ends of the heat roller to supply electric power to the heating portion through the conducting terminals. Since the heating portion and the shaft portions are integrally molded from the same material and the power supply is effected from the two end portions of the molded member, current also flows through the shaft portions, as a matter of course. However, since the inner surfaces of the shaft portions are partly or entirely coated with a soft electrically conductive metal by means, for example, of vapor deposition, plating, or coating to thereby form low-resistance portions, most of current passing through the end portions of the molded member pass through the low-resistance portions, so that the current that passes through the bodies of the shaft portions is extremely small, resulting in a marked lowering in the amount of heat generated from the outer and inner peripheries of the shaft portions.

If the resistance between the axial ends of the molded member before it is coated with an electrically conductive metal is set in the range of 5Ω to 100Ω, when a voltage of 100 V is applied, a calorific power of 2 kW to 100 W is ensured. Thus, the heat roller functions satisfactorily as one used in a fixing device. If the outer end of at least one of the shaft portions at both ends of the molded member has a cross-sectional configuration containing a straight or curved portion, exclusive of a circular arc, in a part thereof or in its entirety, the connection of a rotation driving shaft to this shaft portion is facilitated and ensured.

It is an object of the second and third invention to provide a heat roller which is designed so that electric power is surely supplied from conducting terminals, which are metallic parts, to a heating portion made of a ceramic material, and the ceramic heating member will not be destroyed by thermal expansion of the conducting terminals, and so that the heat roller and feed brushes are readily assembled without requiring strictness for the positional relationship therebetween, and also provide a safety measure to cope with an excessive rise in temperature.

The second invention is characterized in that the heating portion and the shaft portions are integrally molded from the same material in the form of a molded member at least both end portions of which are hollow, and conducting terminals capable of elastically expanding and contracting in the radial direction are closely fitted into the hollow end portions, respectively.

Conducting terminals usable in the present invention include a metallic plate which is bent in the form of a roll, a metallic cylindrical tubular or columnar member formed with axial slits for expansion and contraction, and a tubular member with a corrugated outer peripheral surface, which has a metallic core fitted in the center thereof in contact with the inner surface thereof, the core being longer than the tubular member.

It is preferable to apply to the second invention the technique of coating a soft electrically conductive metal partly or entirely over the inner surface of the hollow portion provided at each axial end of the molded member by means, for example, of vapor deposition, plating, or coating, which is the technique disclosed in the first invention.

It is recommended to form each conducting terminal using a low-melting metal in its entirety or in a longitudinal part thereof from the viewpoint of safety.

The heat roller of the second invention is rotatably supported by bearings which are fitted on the respective outer peripheries of the two shaft portions, and the heating portion is supplied with electric power through the conducting terminals, capable of elastically expanding and contracting in the radial direction, fitted in the hollow portions at both ends of the heat roller. Since the conducting terminals can elastically expand and contract in the radial direction, it is easy to fit them into the hollow portions at both ends of the ceramic molded member, and the fitted terminals can be brought into close contact with the inner walls of the hollow portions. Since the heating portion and the shaft portions are integrally molded from the same material, both end portions of the molded member are heated to a high temperature, so that the conducting terminals expand thermally as the temperature rises. However, since the conducting terminals are capable of elastically expanding and contracting in the radial direction, the thermal expansion is absorbed radially inward.

If a metallic plate that is bent in the form of a roll is employed as each conducting terminal, the thermal expansion is absorbed by the reduction in the distance between the opposing edges of the rolled-up metallic plate or the increase in the overlap of the metallic plate. If a metallic cylindrical tubular or columnar member formed with axial slits for expansion and contraction is employed as each conducting terminal, the thermal expansion is absorbed by the reduction in the distance between the slits.

If each conducting terminal comprises a tubular member with a corrugated outer peripheral surface, which has a metallic core fitted in the center thereof in contact with the inner surface thereof, the core being longer than the tubular member, the thermal expansion is absorbed by the deformation of the corrugated tubular member with the metallic core held therein.

If each conducting terminal capable of elastically expanding and contracting in the radial direction is formed of a low-melting metal in its entirety or in a longitudinal part thereof, when the heat roller excessively rises in temperature, the conducting terminal melts instantaneously to stop the power supply.

The third invention is characterized in that the heating portion and the shaft portions are integrally molded from the same material in the form of a molded member at least both end portions of which are hollow, and coiled conducting terminals are closely fitted into the hollow end portions, respectively.

The arrangement may also be such that a metallic core rod which is soft and shorter than the coiled conducting terminals is closely inserted into each terminal, and the coiled conducting terminals, together with the metallic core rods, are closely fitted into the hollow end portions, respectively.

Further, in combination with the third invention, it is preferable to use the first invention, in which a soft electrically conductive metal is coated on a part or the entirety of the inner surfaces of the hollow portions at both ends of the molded member by means, for example, of vapor deposition, plating, or coating.

In the third invention also, it is desirable to form each conducting terminal of a low-melting metal in its entirety or in a longitudinal part thereof from the viewpoint of enhancement of safety in the same way as in the second invention.

It is also possible to insert a metallic core rod shorter than the coiled conducting terminals into the free end portion of each conducting terminal in close contact with the inner surface thereof, or to fit an annular member shorter than the coiled conducting terminals onto the free end portion of each conducting terminal in close contact with the outer periphery thereof.

The heat roller of the third invention, arranged as described above, is rotatably supported by bearings fitted on the respective outer peripheries of the shaft portions at both ends of the heat roller, and electric power is supplied to the heating portion through the coiled conducting terminals respectively fitted into the two hollow end portions. Since the coiled conducting terminals are capable of elastically expanding and contracting in the radial direction, it is easy to insert them into the hollow end portions of the ceramic molded member, and the fitted conducting terminals can be brought into close contact with the respective inner walls of the hollow portions. Since each of the ring portions that constitute a coiled conducting terminal can expand and contract individually, electric contact is surely made between the coiled conducting terminal and the inner surface of the hollow end portion to ensure a good conducting state even if the inner surface is not smooth. In addition, since the free end portion of each coiled conducting terminal can move relatively freely by deformation of the conducting terminal although the other end of the terminal is fitted into the hollow end portion, it is possible to assemble together the heat roller, the conducting terminals and the feed brushes without the need for a particularly high degree of accuracy, so that the assembling efficiency improves markedly.

In a case where a metallic core rod shorter than the coiled conducting terminals is closely inserted into each conducting terminal and the metallic core rod is closely fitted into the hollow end portion, together with the coiled conducting terminal, the conducting terminal is clamped between the inner surface of the hollow end portion and the metallic core rod, thus enabling the conducting terminal to contact the inner surface of the hollow end portion even more reliably. In addition, since the metallic core rod is soft, it will not excessively press the walls of the shaft portion when the core rod expands thermally.

In a case where a metallic core rod shorter than the coiled conducting terminals is closely inserted into the free end portion of each conducting terminal, or an annular member shorter than the coiled conducting terminals is closely fitted on the outer periphery of the free end portion of each conducting terminal, it becomes easy to make electric contact between each conducting terminal and a feed brush.

In both the second and third inventions, it is preferable to use in combination therewith the first invention, in which a soft electrically conductive metal is coated on a part or the entirety of the inner surface of each hollow end portion of the molded member to form a low-resistance portion by means, for example, of vapor deposition, plating, or coating. In such a case, most of current passing through the shaft portions of the molded member pass through the low-resistance portions, so that the current that passes through the bodies of the shaft portions is extremely small, resulting in a marked lowering in the amount of heat generated from the outer and inner peripheries of the shaft portions.

If a low-melting metal is used to form the entirety or a longitudinal part of each conducting terminal in the second invention which is capable of elastically expanding and contracting in the radial direction or of each coiled conducting terminal in the third invention, when the heat roller excessively rises in temperature, the conducting terminals melt instantaneously to stop the power supply, so that it is possible to prevent an excessive rise in temperature.

It is an object of the fourth invention to disclose an excessive temperature rise preventing means which is simple in structure and inexpensive and which needs an extremely small space for installation or requires no installation space, and to provide a heat roller incorporating this excessive temperature rise preventing means.

The fourth invention is characterized in that the heating portion and the shaft portions are integrally molded from the same material in the form of a molded member both end portions of which are hollow, and conducting terminals are closely fitted into the hollow end portions, at least one of the conducting terminals being supplied with electric power through feed brushes that hold the conducting terminal therebetween, the brushes comprising a pair of electrically conductive contact pieces which are disposed face-to-face with each other, and at least one contact piece being a resilient piece having a bimetallic function.

It is preferable to use coiled conducting terminals which are capable of elastically expanding and contracting in the radial direction, and it is particularly preferable to interpose a short annular member between the coiled conducting terminal and the feed brushes.

It is desirable to coat a soft electrically conductive metal on a part or the entirety of the inner surface of each hollow end portion of the molded member by means, for example, of vapor deposition, plating, or coating, as disclosed in the first invention, with a view to providing even more favorable contact between the conducting terminals and the molded member and to suppressing the rise in temperature of the shaft portions.

This invention can also be applied to heat rollers other than those in which power supply is effected through conducting terminals, for example, a heat roller in which power supply is effected through feed brushes which are in sliding contact with the respective outer peripheral surfaces of both end portions of the heat roller, wherein the feed brushes comprise resilient pieces having a bimetallic function.

In the above-described arrangement, the feed brushes are partly or entirely formed of a bimetal to provide them with a current cut-off function. In this case, however, the feed function and the current cut-off function may be independent of each other. For example, the arrangement may be such that a current cut-off circuit comprising a resilient piece having a bimetallic function and a contact opposed to it is disposed at a position where it can sense the temperature of the heat roller surface, and the current cut-off circuit is interposed between a power supply and a feed brush for supplying electric power from the power supply to the heat roller.

In the heat roller of the fourth invention, arranged as described above, electric power is supplied to the shaft portions from the feed brushes via the conducting terminals to heat the heating portion. The surface temperature of the heating portion is transmitted to the feed brushes by heat conduction through the conducting terminals or radiation heat propagated through space. Since at least one conducting terminal is held between a pair of feed brushes at least one of which comprises a resilient piece having a bimetallic function, when the feed brush temperature rises excessively, the resilient piece is deformed, thereby instantaneously cutting off the power supply to the conducting terminals. When the surface temperature of the heating portion lowers below a predetermined level, the resilient piece returns to the previous configuration to hold the conducting terminal, thereby resuming the power supply to the heating portion.

In a case where a resilient piece having a bimetallic function is employed as a feed brush in a heat roller wherein power supply is effected through feed brushes which are in sliding contact with the respective outer peripheral surfaces of both end portions of the heat roller, when the heat roller excessively rises in temperature, the temperature is sensed by the feed brush which is in sliding contact with the outer peripheral surface of one end portion of the heat roller and, at this time, the feed brush is deformed by virtue of the bimetallic function, thereby cutting off the power supply to the heat roller.

In a case where the feed function and the current cut-off function are provided independently of each other, for example, a current cut-off circuit comprising a resilient piece having a bimetallic function and an opposed contact is disposed at a position where it can sense the temperature of the heat roller surface, and the current cut-off circuit is interposed between a power supply and a feed brush for supplying electric power from the power supply to the heat roller, when the heat roller excessively rises in temperature, the temperature is sensed by the current cut-off circuit that is disposed in close proximity to the heat roller and interposed between the power supply and the feed brush, and the current cut-off circuit cuts off the power supply.

It is an object of the fifth invention to provide a heat roller having a bearing structure which has substantially no deterioration during the process of use and ensures a smooth rotational operation of the heat roller over an exceedingly long period of time and which is simple in structure and inexpensive.

The fifth invention is characterized in that the heating portion and the shaft portions are integrally molded from the same material in the form of a molded member at least both end portions of which are hollow, and the outer peripheries of the shaft portions are supported directly by bearing members made of a heat-resistant and wear-resistant resin material and having no movable parts.

It is preferable to employ polyimide or polyamide imide as a heat-resistant and wear-resistant resin material.

In the fifth invention also, it is preferable to coat a soft electrically conductive metal on a part or the entirety of the inner surface of each hollow end portion of the molded member, which is a heating member, by means, for example, of vapor deposition, plating, or coating, and it is also preferable to set the resistance between the axial ends of the molded member before it is coated with an electrically conductive metal in the range of 5Ω to 100Ω, as in the first invention.

In the fifth invention, the heat roller, which is rotatably supported at the outer peripheries of the shaft portions at both ends thereof by bearings made of a heat-resistant and wear-resistant resin material and having no movable parts, is supplied with electric power for the heating portion by a proper means, so that the whole molded member, comprising the heating portion and the shaft portions, generates heat. The shaft portions are supported by bearings made of a synthetic resin material and having no movable parts, but since the bearings have resistance to the temperature of the shaft portions and also resistance to wear caused by the rotation of the shaft portions, there is no failure of the rotational operation of the heat roller even during long-term service under high-temperature conditions.

It is an object of the sixth invention to minimize the descending regions in the temperature curve of the heat roller by making compensation for the lowering in the temperature at both ends of the heating portion to thereby enlarge the usable region of the heating portion.

To this end, the sixth invention provides a heat roller for use in a fixing device, which comprises a heating portion and shaft portions respectively projecting from both ends of the heating portion, wherein the heating portion and the shaft portions are integrally molded from the same material, and the outer surfaces of regions of the heating portion near the axial end portions, which are outside the usable region of the heating portion, are respectively provided with portions which have a lower resistance than that of the other portion.

The low-resistance portions may be formed by various methods. For example, in a case where the body portion, exclusive of the low-resistance portions, is made of an electrically conductive ceramic material, the low-resistance portions may also be made of an electrically conductive material and calcined simultaneously with the body portion. It is also possible to form low-resistance portions by fitting annular members onto the two shaft portions at both ends of the heat roller, the annular members having a lower resistance than that of the body portion. In a case where low-resistance rings are fitted onto the shaft portions, it is preferable to coat the surfaces of the shaft portions with a soft electrically conductive metal by means, for example, of vapor deposition, plating, or coating, from the viewpoint of improving the electrical conductivity.

When the heat roller of the sixth invention, arranged as described above, is energized, each region of the heating portion generates an amount of heat in accordance with the resistance thereof. Although heat that is generated in the vicinities of both ends of the heating portion is radiated into the ambient atmosphere, since the current that flows through the low-resistance portions formed on the outer surfaces of regions of the heating portion near the axial end portions, which are outside the usable region of the heating portion, is larger than that in the other portion, a larger amount of heat is generated in the low-resistance portions than in the other portion, thereby compensating for the lowering in the temperature at both ends of the heating portion, and thus minimizing the descending regions in the temperature curve. As a result, the uniform temperature range widens, so that the usable region of the heat roller enlarges.

If the electric resistance of the heating portion is set in the range of 5Ω to 100Ω, a calorific power needed for heat fixing is ensured. If the resistance per unit volume of the low-resistance portions is set in the range of 95% to 60% of the resistance per unit volume of the other portion, the heat compensation is made in a favorable condition. In a case where the low-resistance portions and the body portion are made of an electrically conductive ceramic material and these portions are calcined simultaneously, the low-resistance portions and the body portion are bonded together completely, so that no electric conduction failure will occur therebetween. In addition, since the coefficients of thermal expansion of the two different kinds of portion are substantially coincident with each other, there is no possibility that the low-resistance portions or the body portion will be destroyed because of the difference in the coefficient of thermal expansion.

It is an object of the seventh invention to provide a fixing device which is designed so that it is possible to reduce the cost and size of the fixing device and eliminate the need for the paper guide 500 in the prior art.

To this end, the seventh invention provides a fixing device comprising a plate-shaped resilient member which is in press contact with the surface of a heat roller so that the resilient member replaces the rotary press roller in the prior art.

The plate-shaped resilient member may be either a member which per se has resilience or a member which is given resilience by a resilient member, e.g., a spring, which is provided separately. For example, it is possible to employ a plate-shaped resilient member which is fixedly supported at one end thereof which is located forwardly as viewed in a paper feed direction, while the other end thereof is defined as a free end, as a member which per se has resilience.

It is preferable to provide a resin layer having excellent heat resistance and lubricating properties on at least a portion of the plate-shaped resilient member which is in contact with the heat roller. In addition, it is also possible to utilize as a paper guide a portion of the plate-shaped resilient member which is extended forwardly in the paper feed direction.

In the fixing device of the seventh invention, arranged as described above, when a sheet of recording paper is fed into the area between the rotating heat roller and the plate-shaped resilient member which is in press contact with the heat roller, the recording paper is drawn into the area between the two members, thereby effecting heat fixing of the toner image. Since the plate-shaped resilient member is in contact with the heat roller in an elastically deformable state, the recording paper is subjected to uniform pressure and heating over the entire width thereof, thus enabling heat fixing of the toner image to be performed effectively and reliably.

If a heat-resistant resin layer having excellent lubricating properties is provided on at least a portion of the plate-shaped resilient member which is in contact with the heat roller, the feed of recording paper can be effected even more smoothly, and the durability can be improved. In addition, if the plate-shaped resilient member is formed with a gently curved portion which extends forwardly in the paper feed direction, recording paper can be fed into the area between the roller and the resilient member along the upper surface of the extended portion. Accordingly, the plate-shaped resilient member can also serve as a paper guide.

It is an object of the eighth and ninth inventions to provide a heat roller which is capable of realizing an excellent fixing condition without inviting a waste of electric power or a rise in the cost of peripheral parts by enabling uniform heating of the heat roller surface and improving the heating response.

To this end, the eighth invention provides a heat roller having a resin layer for adhesion on the outer surface of a roller body, wherein a silicone resin material of good thermal conductivity is interposed between the roller body and the adhesion resin layer by means, for example, of coating.

It is preferable to use a silicone resin material which is in the form of oil when coated and which is thermoset when the heat roller generates heat. It is particularly preferable to use a silicone resin material which is in the form of oil in the temperature range of −50° C. to 150° C. and thermoset at 150° C. or higher. From the viewpoint of readiness of coating, a silicone resin material having a consistency of 190 to 420 is preferably used. This invention is particularly effective when a heating member made of an electrically conductive ceramic material is employed as the roller body.

In the heat roller of the eighth invention, arranged as described above, a silicone resin material of good thermal conductivity fills the area between the rough surface of the roller body and the adhesion resin layer in conformity to irregularities in the surface of the roller body, and there is therefore no air gap between the roller body surface and the adhesion resin layer. Accordingly, there will be no nonuniformity in the temperature distribution over the heat roller surface, and the heating response can also be improved.

If a silicone resin material which is in the form of oil when coated and which is thermoset when the heat roller generates heats is employed, there is no fear of the silicone resin material flowing out during the process of use. If a silicone resin material having a consistency in the range of 190 to 420 is employed, the coating operation is facilitated.

The ninth invention is characterized in that the outer surface of a roller body is provided with a resin layer for adhesion which comprises one material selected from among polyimide, polyamide imide, and fluorocarbon resins. Since polyimide and polyamide imide are highly fluid and fluorocarbon resins can be coated by spraying, these resin materials have excellent coating properties. Accordingly, these resin materials can be coated so as to level the rough surface of the roller body having minute irregularities. Thus, it becomes unnecessary to interpose a silicone resin material between the roller body and the adhesion resin layer, which is essential in the eighth invention. In addition, since the resin layer can be provided in the form of a thin film, it is possible to minimize the temperature difference between the surface of the roller body, as a heating member, and the heat roller surface, so that a heat roller of excellent heating response can be obtained.

BRIEF DESCRIPTION OF THE DRAWINGS

FIG. 11(*b*) is a perspective view of a conducting terminal in the embodiment of the second invention;

FIG. 12(*b*) is a perspective view of the conducting terminal fitted in the hollow portion;

FIG. 16(*b*) is a sectional view of the conducting terminal shown in FIG. 16(*a*);

FIG. 29(*b*) is a sectional view of a pair of feed brushes holding a conducting terminal of the heat roller shown in FIG. 29(*a*);

FIG. 32(*b*) is a sectional view of a pair of feed brushes of the heat roller shown in FIG. 32(*a*), which hold a coiled conducting terminal;

FIG. 33(*b*) is a side view of the embodiment shown in FIG. 33(*a*);

FIG. 35(*b*) is a fragmentary sectional view of the bearing shown in FIG. 35(*a*), which is fitted on the outer periphery of the heat roller;

FIG. 36(*b*) is a fragmentary sectional view of the bearing shown in FIG. 36(*a*), which is fitted on the outer periphery of the heat roller;

FIG. 37(*b*) is a fragmentary sectional view of the bearing shown in FIG. 37(*a*), which is fitted on the outer periphery of the heat roller;

FIG. 41(*b*) is a fragmentary sectional view of the embodiment shown in FIG. 41(*a*);

FIG. 42(*b*) is a fragmentary sectional view of the heat roller shown in FIG. 42(*a*) after it has been assembled;

FIG. 44(*b*) is a sectional view schematically showing the fixing device shown in FIG. 44(*a*);

FIG. 45(*b*) is a sectional view schematically showing the fixing device shown in FIG. 45(*a*);

FIG. 49(*b*) is a partly-sectioned front view of the fixing device shown in FIG. 49(*a*);

FIG. 49(*c*) is a sectional view schematically showing the fixing device shown in FIG. 49(*a*);

FIG. 58(*b*) is an axial sectional view of the heat roller shown in FIG. 58(*a*);

FIG. 60(*b*) is an axial sectional view of the heat roller shown in FIG. 60(*a*)

DETAILED DESCRIPTION OF PREFERRED EMBODIMENTS

Figure 1:
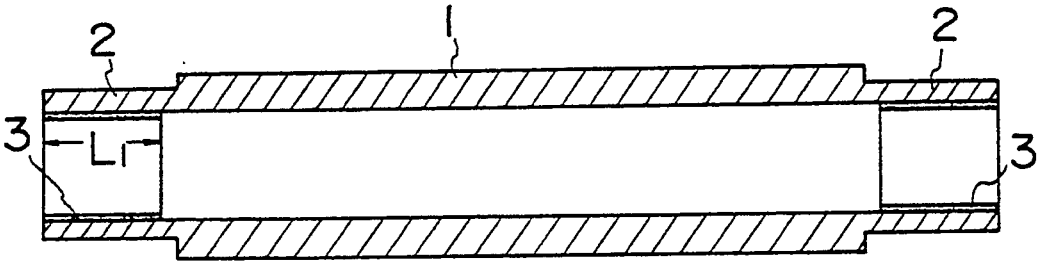
FIG. 1 is an axial sectional view of one embodiment of the heat roller according to the first invention.

The present invention will be described below in detail by way of embodiments and with reference to the accompanying drawings. FIG. 1 shows schematically a heat roller to which the present invention is applied. In the figure, reference numeral 1 denotes a cylindrical heating portion, and 2 a pair of tubular shaft portions respectively projecting from both ends of the heating portion 1. Although the illustrated heating portion 1 is hollow, it may be solid. The heating portion 1 and the shaft portions 2 are integrally molded by using an electrically conductive ceramic material. Examples of electrically conductive ceramic materials usable in the present invention are those which are obtained by blending aluminosilicate ($SiO.Al_2O_3$) or magnesium aluminate ($MgO.Al_2O_3$) with silicon (Si), ferrosilicon (FeSi) or nickel-chromium steel as an electric conductivity controlling material and then calcining the resulting blend. It is also possible to employ a material other than electrically conductive ceramic materials, e.g., a metal, for the heating portion 1 and the shaft portions 2. In such a case, however, it is desirable to set the electric resistance of the heat roller between the two axial ends in the range of 5Ω to 100Ω. If the resistance is less than 5Ω, the calorific power is excessively large, causing a problem in terms of the heat resistance of peripheral members, and there is a fear of heat deterioration of the electrically conductive ceramic material. If the resistance exceeds 100Ω, the calorific power is excessively small, so that it is impossible to effect heat fixing of the toner image.

Reference numeral 3 denotes low-resistance portions formed on the respective inner surfaces of hollow portions at both axial ends of the heat roller from an electrically conductive metal by means, for example, of vapor deposition, plating, or coating. The gist of the first invention resides in the provision of the low-resistance portions 3. The low-resistance portions 3 are extremely thin, and a soft metal, for example, aluminum or copper, is employed as a material therefor. The reason why vapor deposition, plating, or coating is employed as means for providing the low-resistance portions 3 is that an electrically conductive metal can be coated on the surface of the molded member in such a manner as to level irregularities in the surface, so that electric power can be supplied to the molded member in an extremely favorable condition. Although in the illustrated example the length L1 of each low-resistance portion 3 is substantially coincident with the length of the shaft portion 2, the length L1 may be set properly. Since it is only necessary for each low-resistance portion 3 to be as long as the length of the shaft portion 2 at the most, the operation of coating an electrically conductive metal by vapor deposition or the like can be conducted extremely easily. In addition, the low-resistance portions 3 may be formed either entirely or partly on the inner peripheral surfaces of the hollow portions.

Figure 2:
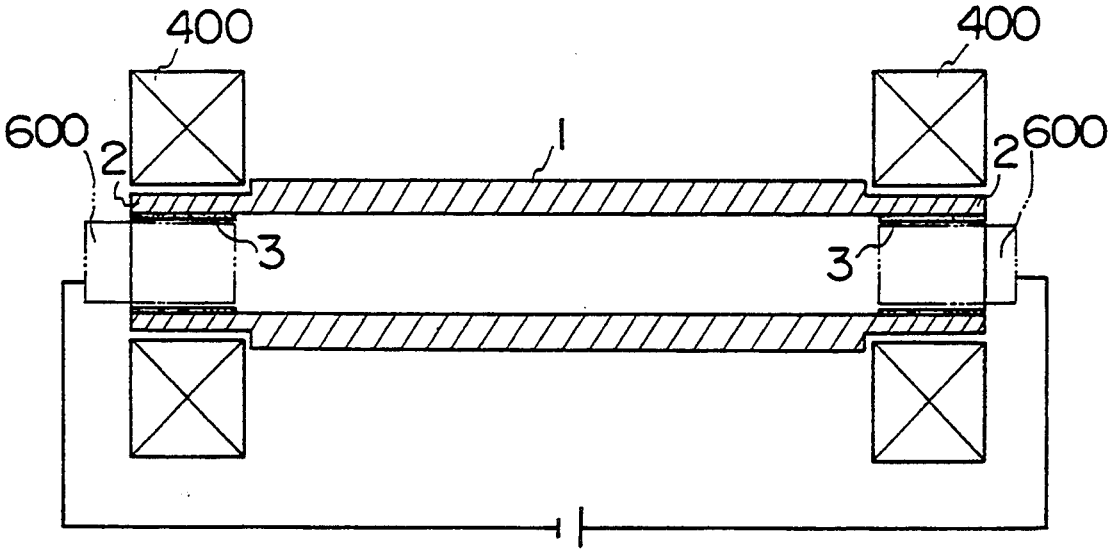
FIG. 2 is an axial sectional view of the heat roller shown in FIG. 1, which has bearings and conducting terminals attached thereto.
Figure 3:
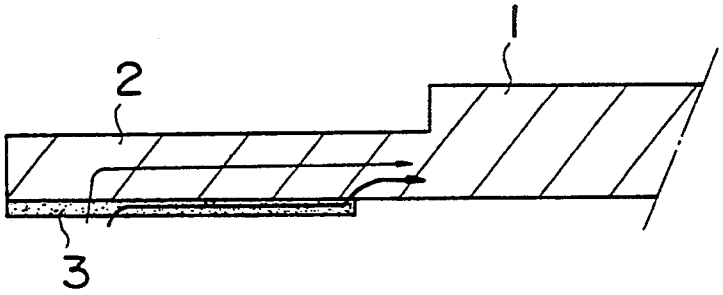
FIG. 3 illustrates the flow of electric current at one axial end portion of the heat roller.
Figure 4:
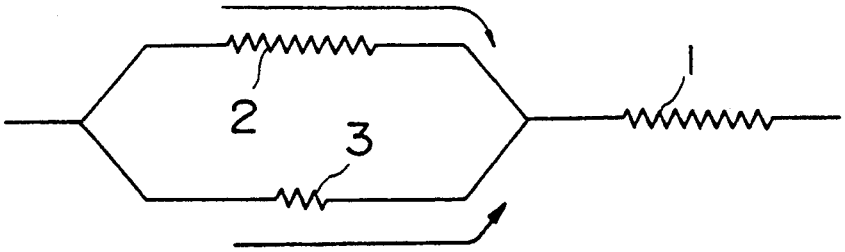
FIG. 4 is an equivalent circuit showing the flow of electric current at one axial end portion of the heat roller.

FIG. 2 shows the heat roller having the above-described arrangement, which is rotatably supported by bearings 400 and has conducting terminals 600 fitted therein as feed means. As the bearings 400, it is possible to employ not only ordinary bearings but also a metal having an inorganic sliding material dispersed therein or a heat-resistant resin material, e.g., polyimide, polyamide imide, etc. Any one of these materials may be properly selected by taking into consideration the temperature of the heat roller, the lifetime thereof and so forth. The outer diameter of the conducting terminals 600 is set so that the terminals 600 can be closely fitted into the respective hollow portions of the shaft portions 2. Since a soft electrically conductive material is coated on the inner peripheral surfaces of the hollow portions, the conducting terminals 600 adhere to the electrically conductive metal in such a manner as to crush thereinto, thereby obtaining good electric contact between the terminals 600 and the respective inner surfaces of the hollow portions. A voltage is applied to the heat roller through the conducting terminals 600 at both ends thereof. FIG. 3 shows schematically the way in which electric current passes through one axial end portion of the heat roller. FIG. 4 expresses the flow of electric current in the form of an equivalent circuit. The greater part of the current flowing in from the area of contact between the axial end portion of the heat roller and the conducting terminal 600 passes through the low-resistance portion 3 coated on the inner peripheral surface of the axial end portion. Accordingly, the current that passes through the body of the shaft portion 2 is extremely small, so that it is possible to minimize the amount of heat generated from the inner and outer peripheral surfaces of the shaft portion 2. Accordingly, the heat load applied to each bearing 400 is only a little, so that even a bearing having low heat resistance can be used. It is therefore possible to use inexpensive bearings such as have heretofore been impossible to use.

Figure 5:
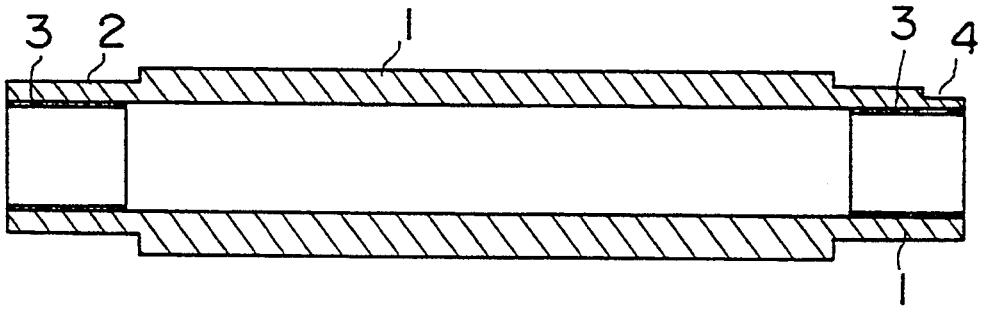
FIG. 5 is an axial sectional view of another embodiment of the heat roller according to the first invention, in which each axial end portion is specially designed.
Figure 6:
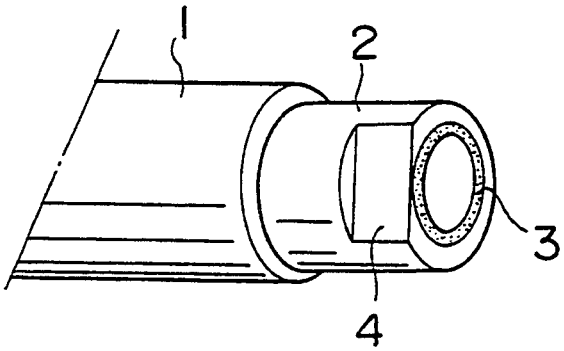
FIG. 6 is a perspective view of an essential part of the second embodiment.
Figure 7A:
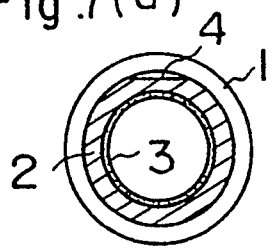
FIGS. 7(*a*) to 7(*d*), FIGS. 8(*a*), 8(*b*), FIGS. 9(*a*) to 9(*d*) and FIGS. 10(*a*) and 10(*b*) are cross-sectional views showing various configurations of the axial end portions.
Figure 7B:
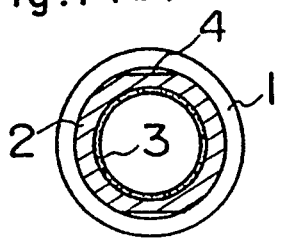
Figure 7C:
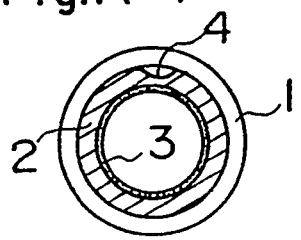
Figure 7D:
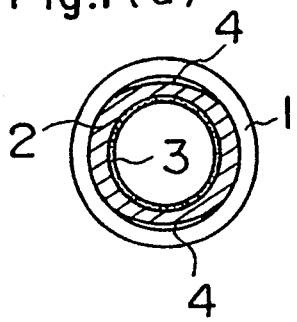
Figure 8A:
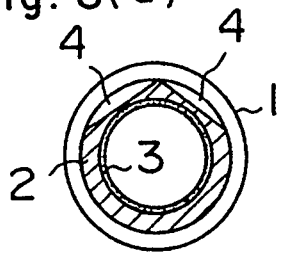
Figure 8B:
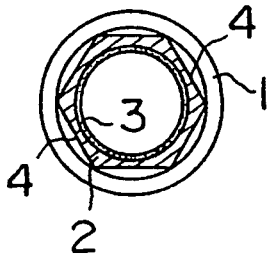
Figure 9A:
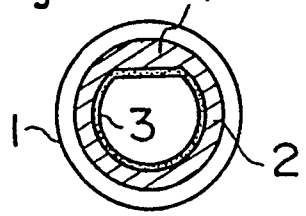
Figure 9B:
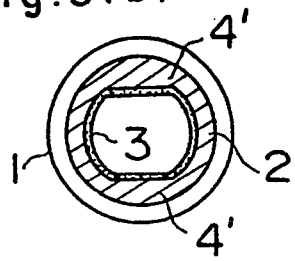
Figure 9C:
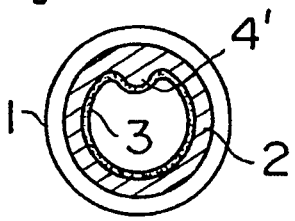
Figure 9D:
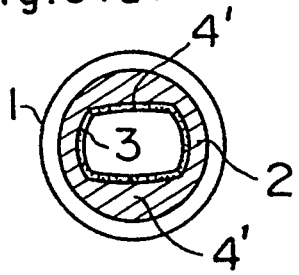
Figure 10A:
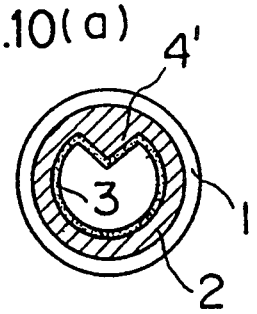
Figure 10B:
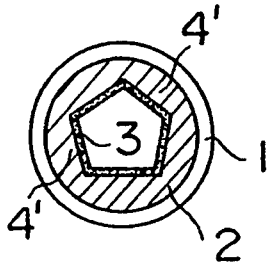

FIGS. 5 to 8 show arrangements in which at least one axial end portion of the heat roller is specially designed in addition to the above-described arrangement so as to facilitate the connection with a driving means for rotation. More specifically, the outer end of at least one of the shaft portions at both ends of the heat roller has a cross-sectional configuration containing a straight or curved portion, exclusive of a circular arc, in a part thereof or in its entirety. FIG. 5 shows an arrangement in which the outer periphery of the right-hand (as viewed in the figure) axial end of the heat roller is provided with a straight cut portion 4, and FIG. 6 is a perspective view of the arrangement shown in FIG. 5. Any configuration may be properly employed for the axial end portion of the heat roller as long as the configuration employed needs no means, e.g., screwing, to connect a driving shaft (not shown) extended from a rotational driving means to the axial end portion and it has no possibility that the driving shaft, after being connected, will fail to engage with the axial end portion. For example, as shown in FIGS. 7(*b*) and 7(*d*), a pair of opposing straight or curved (exclusive of circular arc) portions 4 may be disposed on the outer periphery of an axial end portion of the heat roller. It is also possible to provide a corrugate cut portion 4 on the outer periphery of an axial end portion of the heat roller, as shown in FIG. 7(*c*), or provide a pair of adjacent straight cut portions 4 on the outer periphery of an axial end portion of the heat roller, as shown in FIG. 8(*a*). Further, straight cut portions 4 may be provided on the outer periphery of an axial end portion of the heat roller over the entire circumference, as shown in FIG. 8(*b*). It is also effective practice to form at least one curved (exclusive of circular arc) or straight raised portion 4 on the inner periphery of an axial end portion of the heat roller, as shown in FIGS. 9(*a*) to 9(*d*) and FIGS. 10(*a*) and 10(*b*). If the heat roller has an axial end portion having such a structure, a driving shaft for rotating the heat roller can be connected thereto without employing a securing means, for example, screwing, so that the assembling operation is facilitated. In addition, the driving shaft, after being connected to the heat roller, is prevented from failing to engage with the axial end portion.

Figure 11A:
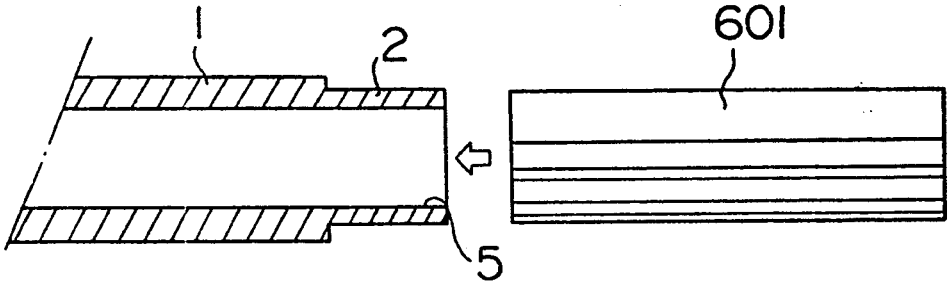
FIG. 11(*a*) is a fragmentary sectional view of one embodiment of the heat roller according to the second invention.
Figure 11B:
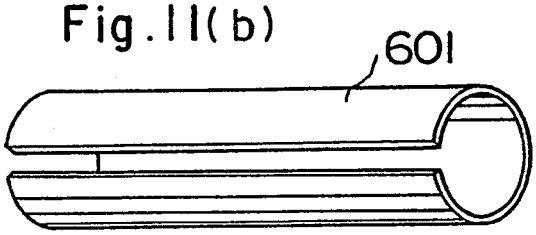
Figure 12A:
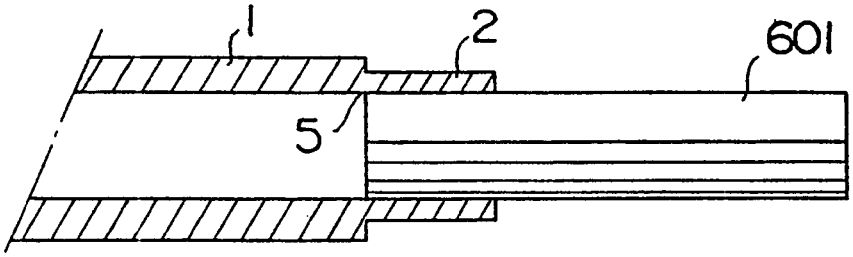
FIG. 12(*a*) is a fragmentary sectional view of the embodiment of the second invention, which is in a state where a conducting terminal is fitted in a hollow portion at an axial end of the heat roller.
Figure 12B:
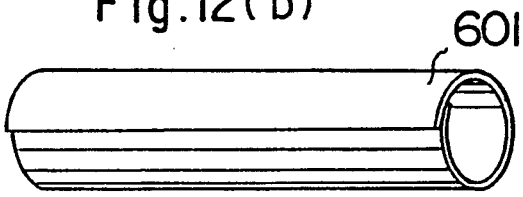

The details of the second invention will next be described. As a conducting terminal 600 that is fitted into the hollow portion at each axial end of the heat roller, a terminal member that is capable of elastically expanding and contracting in the radial direction is used. For example, a metallic plate 601 bent in the form of a roll, as shown in FIGS. 11(*a*) and 11(*b*), may be employed. Before the conducting terminal 601 is fitted into the hollow portion 5 at the axial end of the heat roller, the outer diameter of the terminal 601 is larger than that of the hollow portion 5. When the terminal 601 is inserted into the hollow portion 5, the distance between the opposing end edges of the metallic plate 601 decreases, as shown in FIG. 12(*a*), or the end edge portions of the metallic plate 601 overlap each other, as shown in FIG. 12(*b*), so that the outer diameter of the terminal 601 becomes equal to the diameter of the hollow portion 5. Since the conducting terminal 601 fitted in the hollow portion 5 acts in such a manner as to expand outwardly, the outer peripheral surface thereof comes in close contact with the inner surface of the hollow portion 5, thus enabling good electric contact to be ensured. In addition, although the conducting terminal 601, which is a metallic member, expands thermally as the temperature of the axial end portion of the heat roller rises, since the terminal 601 is capable of expanding and contracting radially, when the opposing end edges of the metallic plate 601 are separate from each other, the distance therebetween decreases, whereas, when the end edge portions of the metallic plate 601 overlap each other, the overlap increases, thus enabling the thermal expansion to be absorbed effectively.

Figure 13:
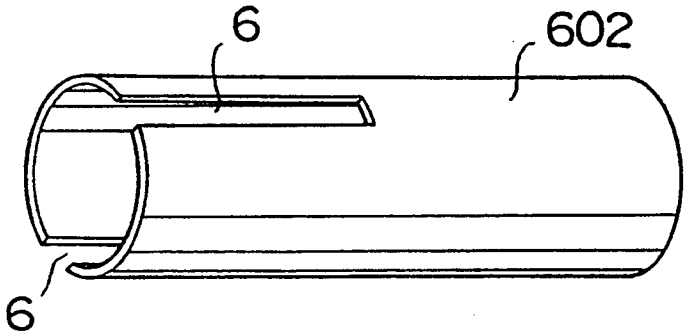
FIG. 13 is a perspective view of another example of the conducting terminal.
Figure 14:
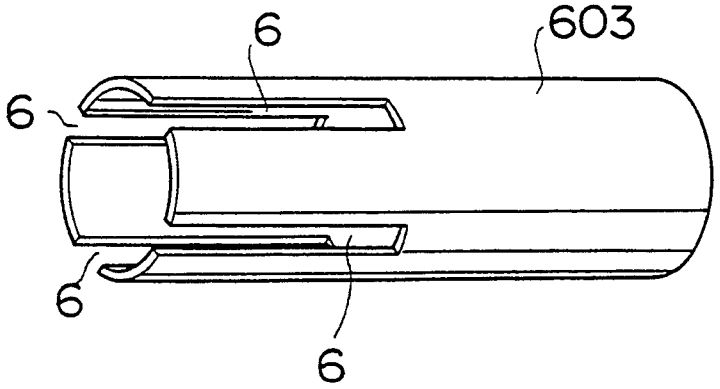
FIG. 14 is a perspective view of still another example of the conducting terminal.
Figure 15:
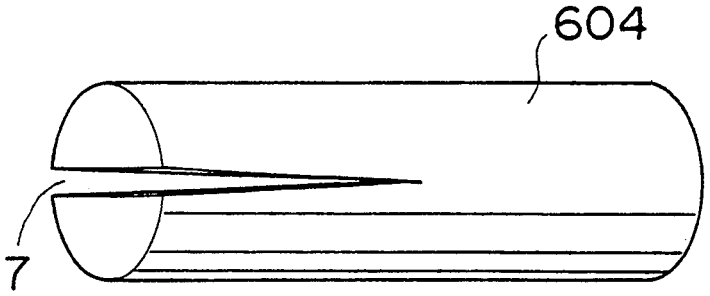
FIG. 15 is a perspective view of a further example of the conducting terminal.

It is possible to employ other configurations for the conducting terminal as long as the terminal is capable of elastically expanding and contracting in the radial direction. For example, a conducting terminal having a plurality of axially elongated slits 6 formed in the outer peripheral surface thereof, as shown in FIGS. 13 and 14, may be employed. In addition, the conducting terminal may be solid. For example, a columnar conducting terminal 604 that is formed with a slit 7, as shown in FIG. 15, may be employed.

Figure 16A:
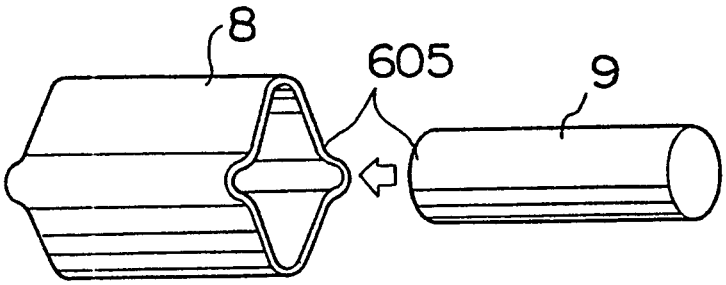
FIG. 16(*a*) is a perspective view of a still further example of the conducting terminal.
Figure 16B:
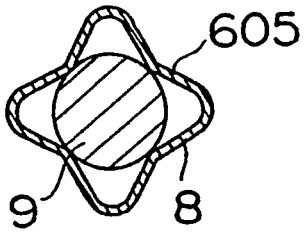

FIG. 16 shows another embodiment of the second invention, in which a tubular member 8 having a corrugated outer peripheral surface is employed, and a columnar metallic core 9 is fitted in the center of the tubular member 8 in such a manner that the core 9 is in contact with the inner surface of the tubular member 8. In this embodiment, the thermal expansion is absorbed by deformation of the tubular member 8, but even after the deformation the metallic core 9 is maintained in the retained state. It is necessary to connect feed brushes (not shown) to one end of the conducting terminal in order to supply electric power to the terminal. However, since in this embodiment the metallic core 9 projects from the tubular member 8, power supply from the feed brushes is facilitated by holding the metallic core 9 with the feed brushes.

Figure 17:
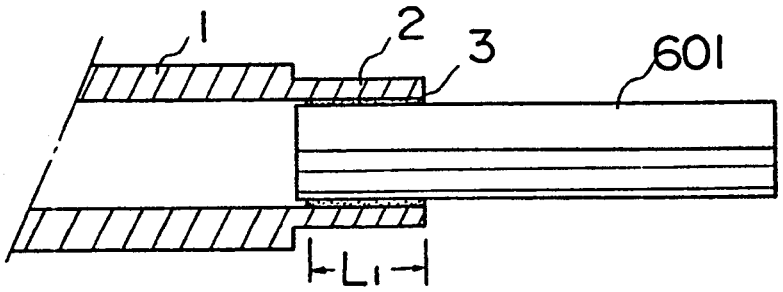
FIG. 17 is a fragmentary sectional view of another embodiment of the second invention, in which a low-resistance portion is formed on the inner surface of a hollow portion at an axial end of the heat roller.

FIG. 17 shows another embodiment of the second invention, in which the technique disclosed in the first invention is applied to the above-described arrangement related to the conducting terminal. More specifically, a low-resistance portion 3 of an electrically conductive metal is formed on the inner surface of the hollow portion at each axial end of the heat roller by means, for example, of vapor deposition, plating, or coating, thereby improving the electric contact between the inner surface of the hollow portion and the conducting terminal, and also preventing the axial end portion from being heated to a high temperature in order to minimize the heat load to peripheral parts, e.g., a bearing.

Figure 18:
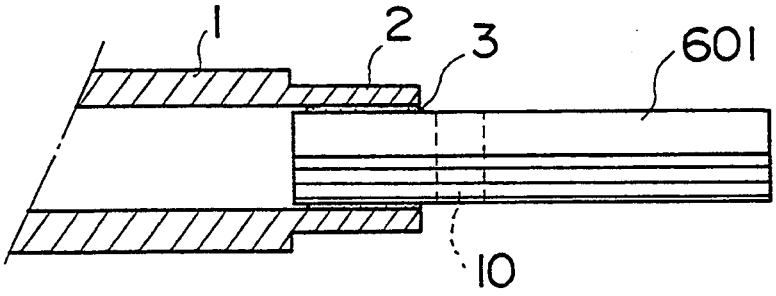
FIG. 18 is a fragmentary sectional view of still another embodiment of the second invention, in which a low-resistance portion is formed on the inner surface of a hollow end portion of the heat roller and a conducting terminal is made of a low-melting metal in a part thereof.
Figure 19:
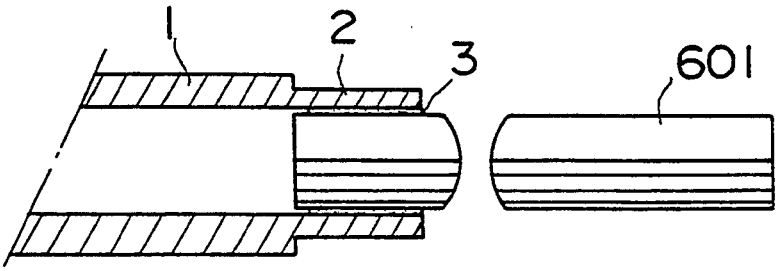
FIG. 19 is a fragmentary sectional view of the embodiment shown in FIG. 18, which is in a state where the conducting terminal has melted.

FIG. 18 shows another embodiment of the second invention, in which a safety function is added to the conducting terminal in addition to the above-described arrangement. More specifically, a longitudinal portion of the conducting terminal 601 is formed by using a low-melting metal 10. In general, the heat roller is used in the temperature range of 180° C. to 200° C., although it depends on the kind of toner employed. Therefore, a metal that melts at a temperature of the order of 230° C. to 250° C., e.g., lead alloy or zinc alloy, is usable as the low-melting metal 10. If such a conducting terminal is employed, when the heat roller excessively rises in temperature, the conducting terminal 601 melts instantaneously, as shown in FIG. 19, to cut off the power supply. It is therefore possible to prevent completely the occurrence of a fire or other accident, and also prevent deterioration of the heat roller and peripheral parts, which are costly. Moreover, since this method is extremely simple in terms of the mechanism, there will be substantially no rise in the production cost.

Figure 20:
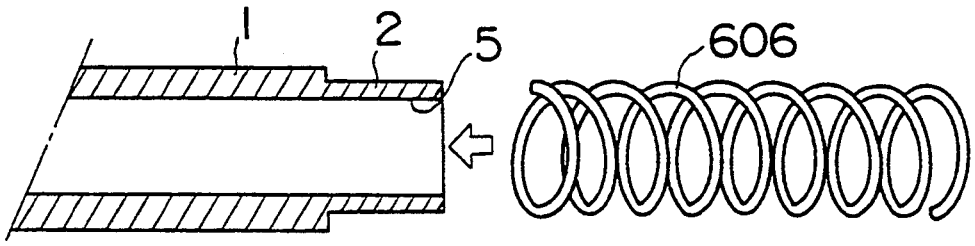
FIG. 20 is a fragmentary sectional view of one embodiment of the heat roller according to the third invention.
Figure 21:
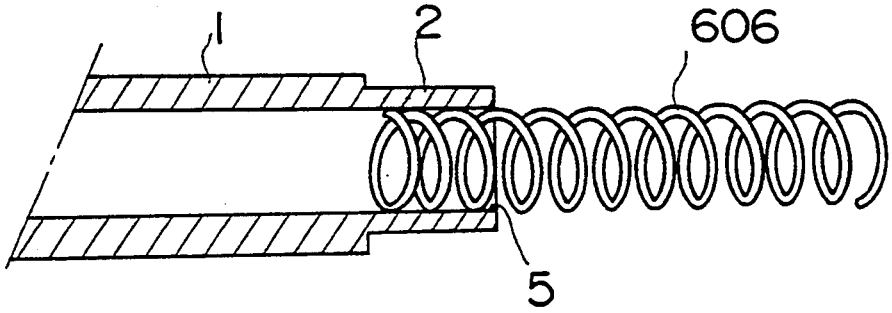
FIG. 21 is a fragmentary sectional view of the embodiment shown in FIG. 20, which is in a state where a coiled conducting terminal is fitted in a hollow end portion of the heat roller.

FIGS. 20 to 27 show embodiments of the third invention. The gist of the third invention resides in an arrangement wherein a coiled conducting terminal 606 is fitted into the hollow portion 5 at an axial end of the heat roller. As shown in FIG. 20, before the coiled conducting terminal 606 is fitted in the hollow portion 5, the outer diameter of the terminal 606 is larger than the diameter of the hollow portion 5. However, when the terminal 606 is inserted into the hollow portion 5, as shown in FIG. 21, the coil diameter decreases, so that the outer diameter of the terminal 606 becomes equal to the diameter of the hollow portion 5. Since the coiled conducting terminal 606 fitted in the hollow portion 5 acts in such a manner as to expand outwardly, the coil of the terminal 606 comes in close contact with the inner surface of the hollow portion 5. Moreover, since each of the ring portions constituting the coil expands independently, even if there should be minute steps or other irregularities in the inner surface of the hollow portion 5, or even if the outer diameter of the coiled conducting terminal 606 should be a little uneven in the axial direction, it is possible to obtain good electric contact between the coiled conducting terminal 606 and the inner surface of the hollow portion 5.

Figure 22:
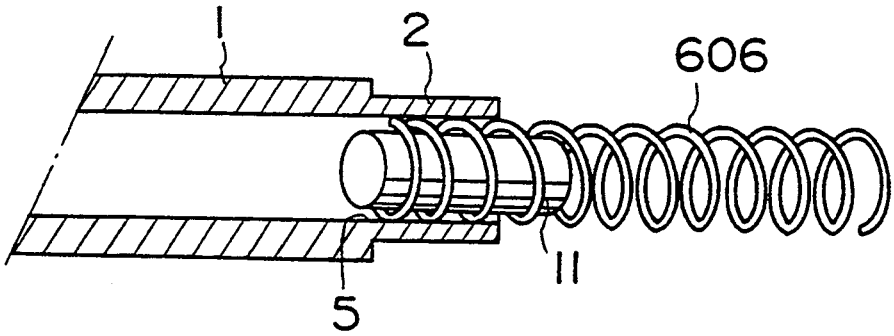
FIG. 22 is a fragmentary sectional view of another embodiment of the heat roller according to the third invention, in which a metallic core rod is inserted into a coiled conducting terminal and these members are fitted in a hollow end portion of the heat roller together as one unit.

The arrangement may also be such that a metallic core rod 11 which is soft and shorter than the coiled conducting terminal 606 is closely inserted into the conducting terminal 606 and the core rod 11 is closely fitted into the hollow portion 5, together with the terminal 606 as one unit, as shown in FIG. 22. The metallic core rod 11 is made of such a material that when the core rod 11 expands thermally, the outer profile thereof is deformed in conformity with the configuration of the coiled conducting terminal 606 so that the core rod 11 fills the gap between each pair of adjacent ring portions constituting the coiled conducting terminal 606. For example, lead alloy or zinc alloy may be used as a material for the coiled conducting terminal 606. With this arrangement, the coiled conducting terminal 606 is clamped between the inner wall of the hollow portion 5 and the metallic core rod 11, so that the contact between the terminal 606 and the hollow portion 5 is even more ensured. Since a soft metal is employed for the metallic core rod 11, there is no possibility of the core rod 11 excessively pressing the wall of the axial end when it expands thermally.

Figure 23:
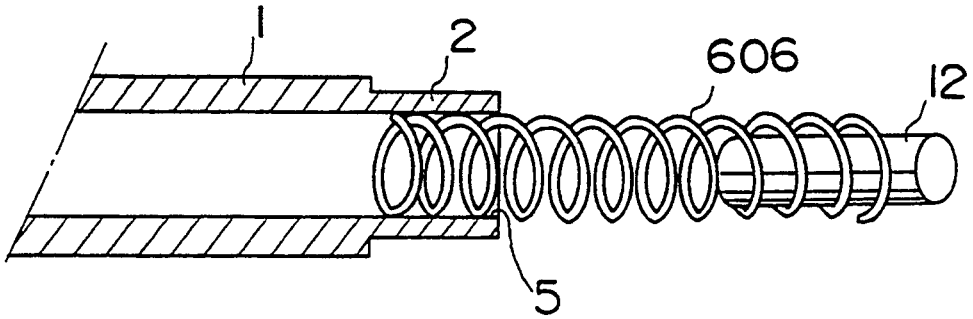
FIG. 23 is a fragmentary sectional view of still another embodiment of the third invention, in which a metallic core rod is inserted into the free end portion of a coiled conducting terminal.
Figure 24:
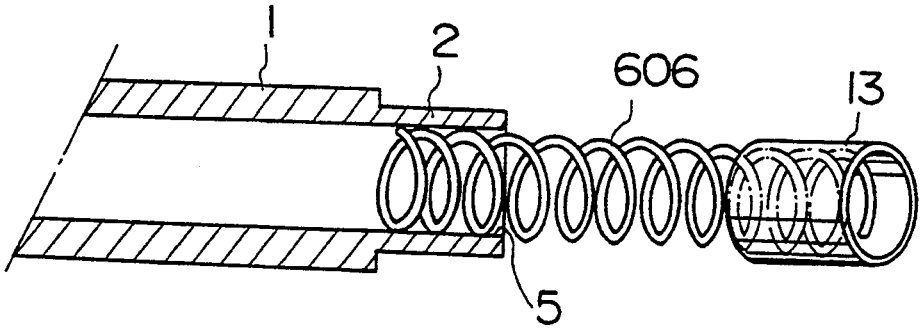
FIG. 24 is a fragmentary sectional view of a further embodiment of the third invention, in which an annular member is fitted on the free end portion of a coiled conducting terminal.

FIG. 23 shows an arrangement in which a metallic core rod 12 which is shorter than the coiled conducting terminal 606 is closely inserted into the free end portion of the terminal 606, and FIG. 24 shows an arrangement in which an annular member 13 which is shorter than the coiled conducting terminal 606 is closely fitted onto the free end portion of the terminal 606. These arrangements facilitate the connection of the coiled conducting terminal 606 to feed brushes (not shown) and ensure good electric contact with the feed brushes.

Figure 25:
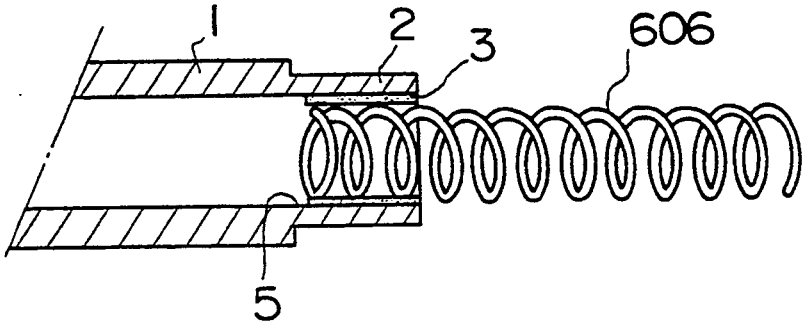
FIG. 25 is a fragmentary sectional view of a still further embodiment of the heat roller according to the third invention, in which a low-resistance portion is formed on the inner surface of a hollow end portion of the heat roller.

FIG. 25 shows a further embodiment of the third invention, in which the technique disclosed in the first invention is applied to the above-described arrangement related to the conducting terminal. More specifically, a low-resistance portion 3 of an electrically conductive metal is formed on the inner surface of the hollow portion 5 at an axial end of the heat roller by means, for example, of vapor deposition, plating, or coating.

Figure 26:
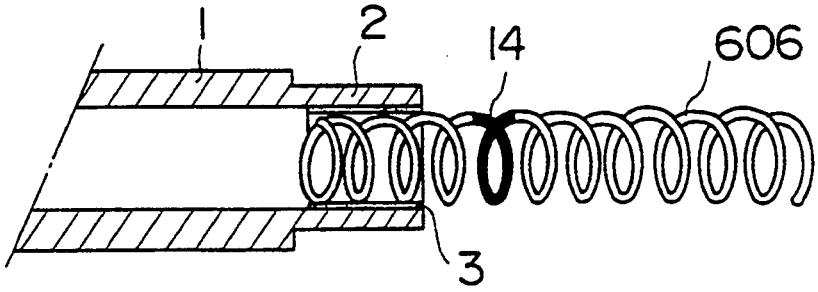
FIG. 26 is a fragmentary sectional view of a still further embodiment of the heat roller according to the third invention, in which a low-resistance portion is formed on the inner surface of a hollow end portion of the heat roller, and a coiled conducting terminal is made of a low-melting metal in a part thereof.
Figure 27:
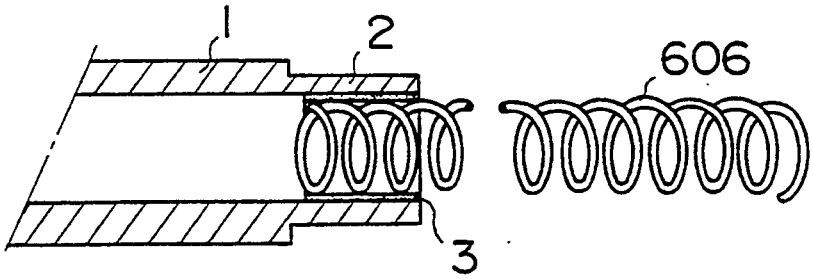
FIG. 27 is a fragmentary sectional view of the embodiment shown in FIG. 26, which is in a state where the coiled conducting terminal has melted.

FIG. 26 shows a further embodiment of the third invention, in which a safety function is added to the coiled conducting terminal 606 in addition to the above-described arrangement. That is, a longitudinal portion of the coiled conducting terminal 606 is formed by using a low-melting metal 14. Examples of the low-melting metal 14 usable in this embodiment are similar to those mentioned in the second invention. With such a coiled conducting terminal 606, when the heat roller excessively rises in temperature, the coiled conducting terminal 606 instantaneously melts to cut off the power supply, as shown in FIG. 27.

The details of the fourth invention will next be described. The fourth invention relates to a technique of preventing an excessive rise in temperature of the heat roller and, more particularly, to a heat roller incorporating an excessive temperature rise preventing means which is simple in structure and inexpensive and which needs an extremely small space for installation or requires no installation space.

Figure 28:
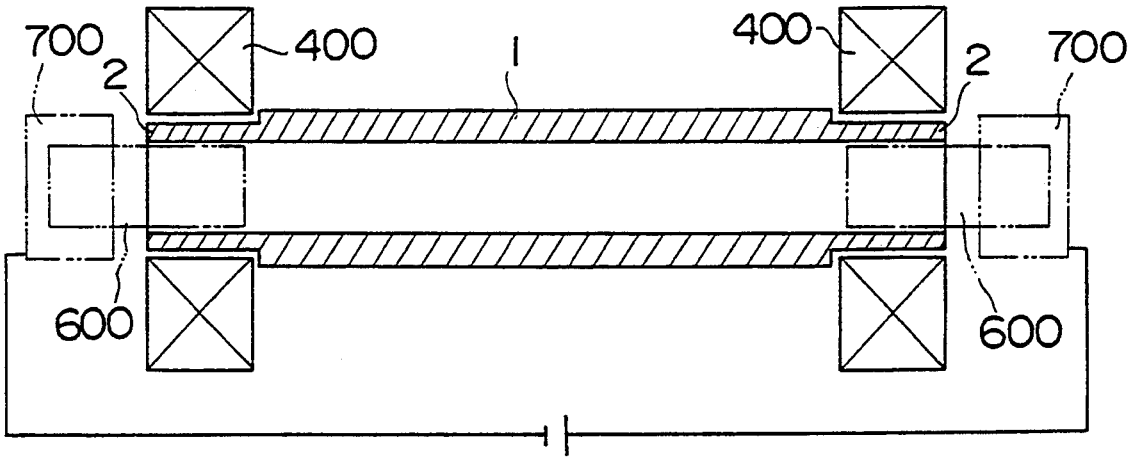
FIG. 28 shows schematically a heat roller to which the fourth invention is applied.

FIG. 28 shows one example of the heat roller structure to which the fourth invention is applied. In the arrangement shown in FIG. 28, the heat roller is rotatably supported by bearings 400, and power supply is effected by feed brushes 700 through conducting terminals 600 that are fitted to the respective inner surfaces of shaft portions 2 at both ends of the heat roller.

Figure 29A:
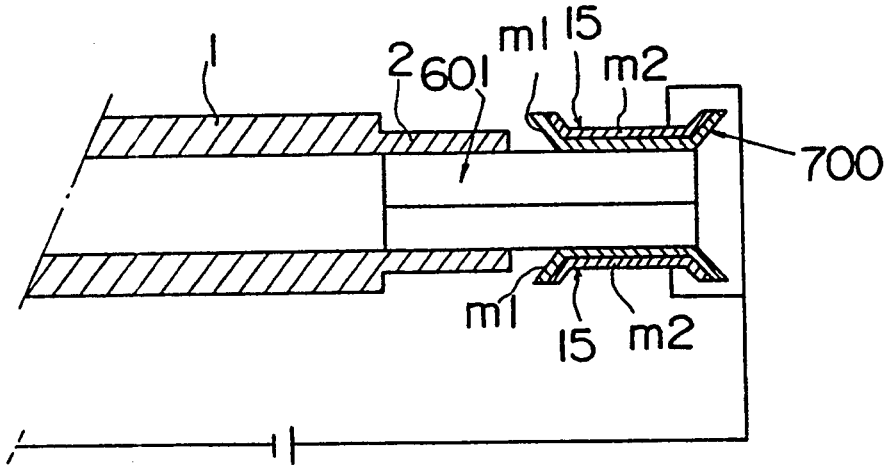
FIG. 29(*a*) is a fragmentary sectional view of one embodiment of the heat roller according to the fourth invention.
Figure 29B:
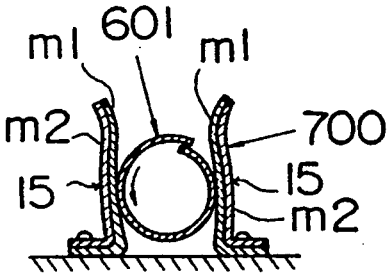
Figure 30:
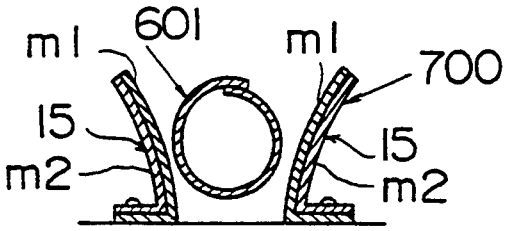
FIG. 30 is a sectional view of the feed brushes of the heat roller shown in FIG. 29, which is in a state where the conducting terminal is released from the feed brushes.

The feature of the fourth invention resides in that the feed brushes 700 in the heat roller having the above-described arrangement are provided with a current cut-off function that utilizes a bimetal. The bimetal is a strip of two metals with different coefficients of thermal expansion, which are welded together. The bimetallic strip is combined with a contact to form a switch that opens or closes at a predetermined temperature. Thus, the bimetal can be expected to perform a reliable operation with an extremely simple structure. In this invention, the bimetallic function is added to the feed brushes 700. For example, two metals m1 and m2 with different coefficients of thermal expansion are welded together to form a resilient electrically conductive contact piece 15, and a pair of such contact pieces 15 are disposed face-to-face with each other in such a manner as to hold a conducting terminal 600, as shown in FIGS. 29(*a*) and 29(*b*). When the surface temperature of the heat roller rises above a predetermined level, the electrically conductive contact pieces 15 bend outwardly by virtue of the resilience, as shown in FIG. 30, so that the inner surfaces thereof separate from the conducting terminal 600 to cut off the power supply to the heat roller. When the surface temperature of the heat roller lowers below a predetermined level, the electrically conductive contact pieces 15 return to the previous configuration to hold the conducting terminal 600 therebetween, thus resuming the power supply to the heat roller.

Figure 31:
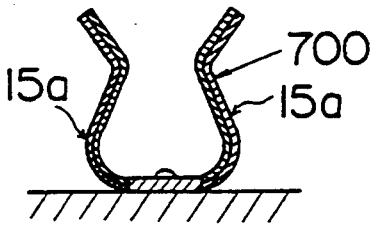
FIG. 31 is a sectional view of another example of the feed brushes.

Although in the above-described embodiment both the opposing contact pieces 15 constituting the feed brushes 700 have the bimetallic function, the bimetallic function may be given to only one contact piece 15. It is also possible to give the bimetallic function to a part of the electrically conductive contact piece 15. In addition, the configuration of the feed brushes 700 is not necessarily limitative to that shown in FIG. 30. For example, it is also possible to employ a U-shaped feed brush structure in which a pair of opposing electrically conductive contact pieces 15*a* are formed in an integral structure, as shown in FIG. 31. With such a configuration, the feed brush 700 can be secured with a single screw 16, so that the feed brush mounting operation is facilitated.

In the arrangement shown in FIGS. 29 and 30, a metallic plate bent in the form of a roll is employed as a conducting terminal 600, which is the same as that employed in the embodiment of the second invention, shown in FIG. 11. More specifically, by arranging the conducting terminal 600 so as to be capable of elastically expanding and contracting in the radial direction, the terminal 600 is allowed to come into close contact with the inner wall of the axial end portion of the heat roller, thereby improving the conduction of electric current and also preventing the conducting terminal 600, when thermally expanded, from destroying the axial end portion made of a ceramic material, which expands only slightly on heating.

Figure 32:
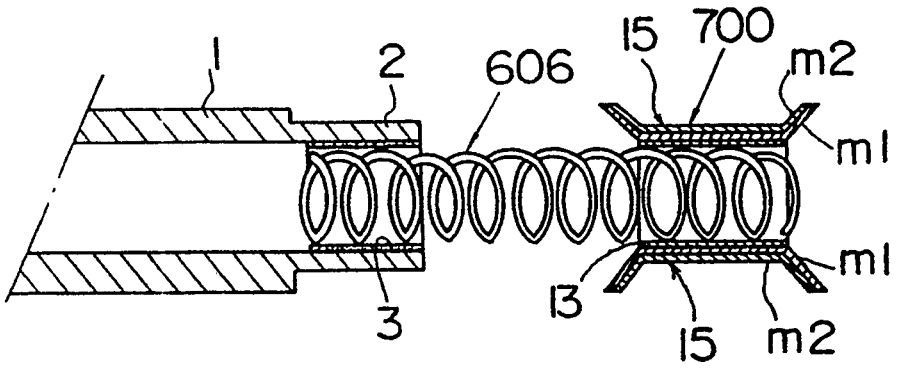
FIG. 32(*a*) is a fragmentary sectional view of another embodiment of the fourth invention, in which a coiled conducting terminal is employed.
Figure 32B:
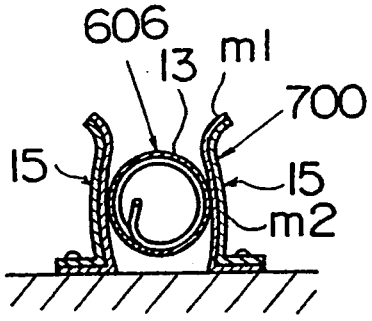

As the conducting terminal 600, another type of conducting terminal may also be employed as long as it is capable of elastically expanding and contracting in the radial direction. For example, a coiled conducting terminal 606 such as that shown in FIG. 32 may be employed. Although one end portion of the coiled conducting terminal 606 is inserted into the hollow portion at an axial end of the heat roller, the free end portion of the terminal 606 is movable relatively freely by deformation of the conducting terminal 606. Therefore, with such a coiled conducting terminal 606, it becomes unnecessary to align the heat roller, the conducting terminals and the feed brushes with a particularly high degree of accuracy during the assembling operation, so that the assembling efficiency improves markedly.

Reference numeral 13 in the figure denotes an annular member fitted onto the free end portion of the coiled conducting terminal 606, which has been described in connection with the third invention. The annular member 13 facilitates the setting of the coiled conducting terminal 606 to the feed brushes 700. After the completion of the setting, the annular member 13 rotatably holds the coiled conducting terminal 606 to thereby ensure the electric contact between the rotating conducting terminal 606 and the feed brushes 700.

Reference numeral 3 in the figure denotes a low-resistance portion which is formed on the inner surface of the hollow portion at the axial end of the heat roller from an electrically conductive metal by means, for example, of vapor deposition, plating, or coating.

Figure 33A:
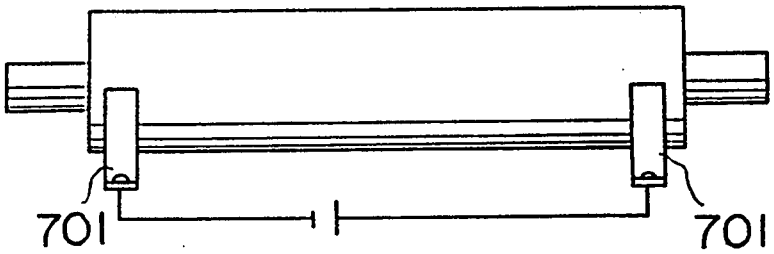
FIG. 33(*a*) is a plan view of still another embodiment of the fourth invention.
Figure 33B:
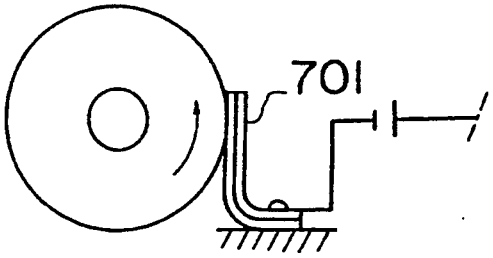

FIGS. 33(*a*) and 33(*b*) show another embodiment of the fourth invention, in which the invention is applied to an arrangement wherein the power supply to the heat roller is effected through feed brushes 701 which are in sliding contact with the respective outer peripheries of both end portions of the heat roller. In this embodiment, at least one of the feed brushes 701 is formed by using a bimetal, as shown in FIG. 33(*b*). Thus, when the heat roller excessively rises in temperature, the feed brush 701 that is in sliding contact with the heat roller bends outwardly to cut off the power supply to the heat roller.

Figure 34:
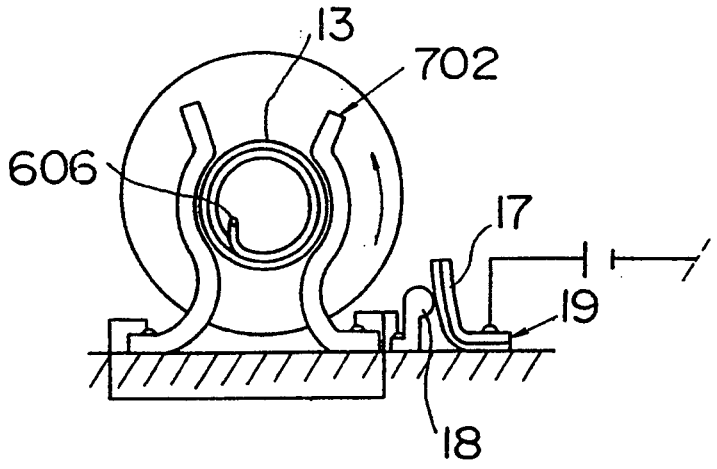
FIG. 34 shows a further embodiment of the fourth invention.

FIG. 34 shows another embodiment of the fourth invention. Unlike the above-described two embodiments in which the feed brush itself is provided with a bimetallic function, this embodiment is arranged such that a current cut-off circuit 19 comprising a resilient piece 17 having a bimetallic function and an opposed contact 18 is prepared separately from feed brushes 702 and disposed at a position where it can sense the temperature of the surface of the heat roller, and the current cut-off circuit 19 is interposed between a power supply and the feed brushes 702 for supplying electric power from the power supply to the heat roller. In this embodiment, when the heat roller excessively rises in temperature, the resilient piece 17 constituting the current cut-off circuit 19 bends outwardly to cut off the supply of electric current, and when the surface temperature of the heat roller lowers to a predetermined level, the resilient piece 17 returns to the previous position to resume the power supply.

Thus, in the heat roller of this invention, the feed brush itself is provided with a bimetallic function, or a current cut-off circuit having a bimetallic function is interposed between the feed brushes and the power supply. Therefore, when the heat roller excessively rises in temperature, the bimetal operates instantaneously to cut off the power supply to the heat roller. When the surface temperature of the heat roller lowers to a predetermined level as a result of the current cut-off operation, the bimetal returns to the previous position instantaneously to resume the power supply. Accordingly, the surface temperature of the heat roller can be maintained at a constant level, so that it is possible to prevent deterioration of the heat roller and peripheral parts and the occurrence of a fire due to an excessive rise in temperature. Moreover, since this invention makes use of a bimetal, the structure is simple, a reduction in the size is achievable, and the cost is extremely low. Thus, this invention is readily adaptable to mass-production.

Figure 35A:
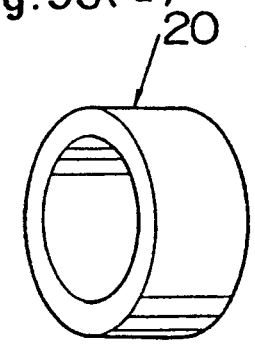
FIG. 35(*a*) is a perspective view of one example of a bearing made of a heat-resistant and wear-resistant resin material in one embodiment of the heat roller according to the fifth invention.
Figure 35B:
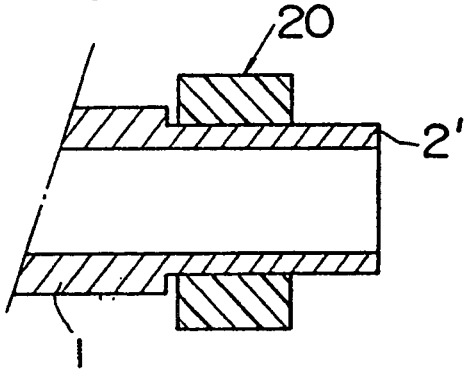

Next, the fifth invention will be described in detail by way of an illustrated embodiment. The feature of the fifth invention resides in a heat roller having the above-described arrangement, wherein both ends of the heat roller are rotatably supported not by the conventionally employed bearings but by bearings 20 made of a heat-resistant and wear-resistant resin material and having no movable parts, as shown in FIG. 35(*a*), and the outer periphery of each shaft portion of the heat roller is supported directly by the bearing 20, as shown in FIG. 35(*b*). The end portion of at least one tubular shaft portion 2' is projected outwardly from the bearing 20 to define a connecting portion for connection with a driving means. For example, an annular member having an inner diameter with which it can be closely fitted onto the outer periphery of the tubular shaft portion 2' is employed as a heat-resistant and wear-resistant resin bearing 20, as shown exemplarily in the figure. As a material for the annular member 20, a heat-resistant and wear-resistant resin, for example, polyimide, polyamide imide, etc., may be employed. Polyimide has high heat resistance, i.e., about 300° C. in terms of continuous serviceable temperature, and about 400° C. in terms of short-term serviceable temperature, so that it is capable of satisfactorily enduring the surface temperature of the heat roller. In addition, polyimide also has high mechanical strength and superior wear resistance and is therefore capable of satisfactorily enduring the sliding contact with the shaft portion 2 of the heat roller.

Such a heat-resistant and wear-resistant bearing can be obtained by compacting a material powder into a predetermined shape and thereafter heat-treating it at a high temperature. In addition, the inner peripheral surface of the bearing is smoothed to reduce the coefficient of friction, thereby improving the lubricating properties.

Figure 36A:
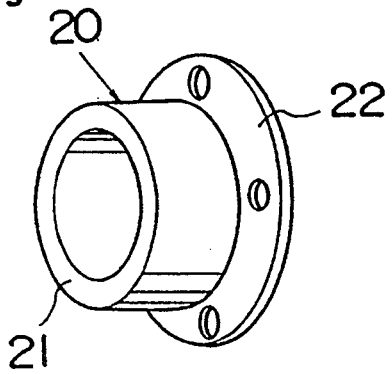
FIG. 36(*a*) is a perspective view of another example of the bearing made of a heat-resistant and wear-resistant resin material.
Figure 36B:
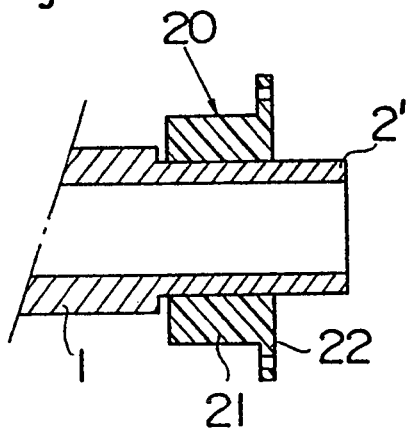
Figure 37A:
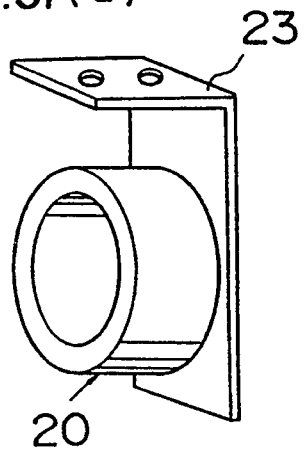
FIG. 37(*a*) is a perspective view of still another example of the bearing made of a heat-resistant and wear-resistant resin material.
Figure 37B:
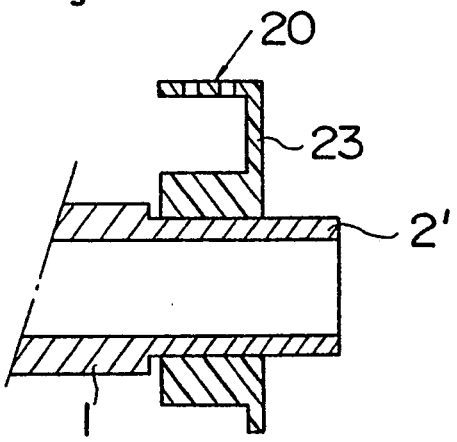

Various bearing configurations may be considered. For example, it is possible to employ a bearing 20 comprising an annular portion 21 and a flange 22 which is provided at one end of the annular portion 21 as an integral part thereof to serve as a mounting member which is attached to the apparatus body, as shown in FIG. 36, or a bearing 20 comprising an annular portion and a hook-shaped mounting member 23 which is provided at one end of the annular portion as an integral part thereof, as shown in FIG. 37.

Figure 38:
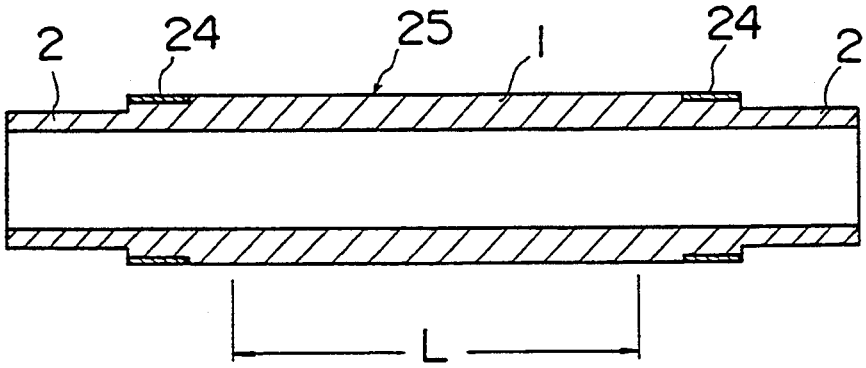
FIG. 38 is a sectional view of one embodiment of the heat roller according to the sixth invention.

Next, the details of the sixth invention will be described by way of illustrated embodiments. It is an object of the sixth invention to enlarge the usable region of the heating portion in the heat roller. To attain the object, the sixth invention provides a heat roller wherein low-resistance portions 24 are respectively provided over the entire circumference of the outer surfaces of regions near both axial end portions of the heat roller, which are outside a usable region L of a heating portion 1, the low-resistance portions 24 having a lower resistance than that of the other portion of the heat roller, as shown in FIG. 38. Like the other portion (hereinafter referred to as "body portion 25") of the heat roller, the low-resistance portions 24 are formed by using an electrically conductive ceramic material. By adjusting the amount of an electrically conductive component, e.g., iron powder, blended with the ceramic material, the electric conductivity of the low-resistance portions 24 is made higher than that of the body portion 25. It is preferable that the low-resistance portions 24 be formed by combining uncalcined annular members of a low-resistance material with the body portion 25 before calcination and then calcining them together. With this method, the body portion 25 and the low-resistance portions 24 can be completely united with each other, so that the electric contact between the body portion 25 and the low-resistance portions 24 becomes very good, thus enabling electric current to flow to the low-resistance portions 24 satisfactorily. Since the composition of the material forming the low-resistance portions 24 is substantially equal to that of the material forming the body portion 25, the coefficients of thermal expansion are substantially equal to each other, so that there is no possibility of the heat roller cracking during the process of use owing to the thermal expansion coefficient difference.

Figure 39:
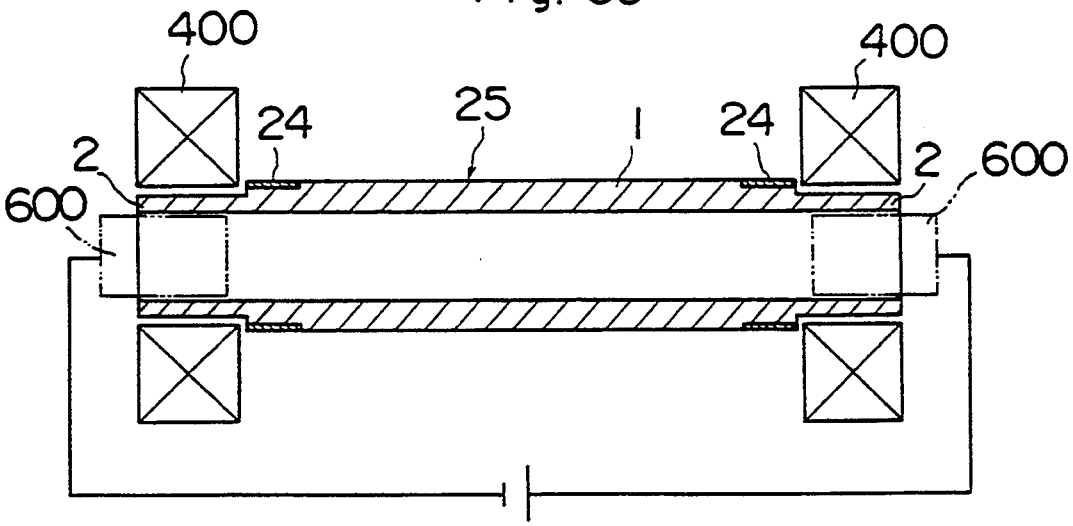
FIG. 39 is a sectional view illustrating the way in which the heat roller shown in FIG. 38 is used.

The heat roller arranged as described above is rotatably supported by bearings 400 and supplied with electric power through conducting terminals 600 fitted to the respective inner surfaces of shaft portions at both ends of the heat roller, as shown in FIG. 39.

Figure 40:
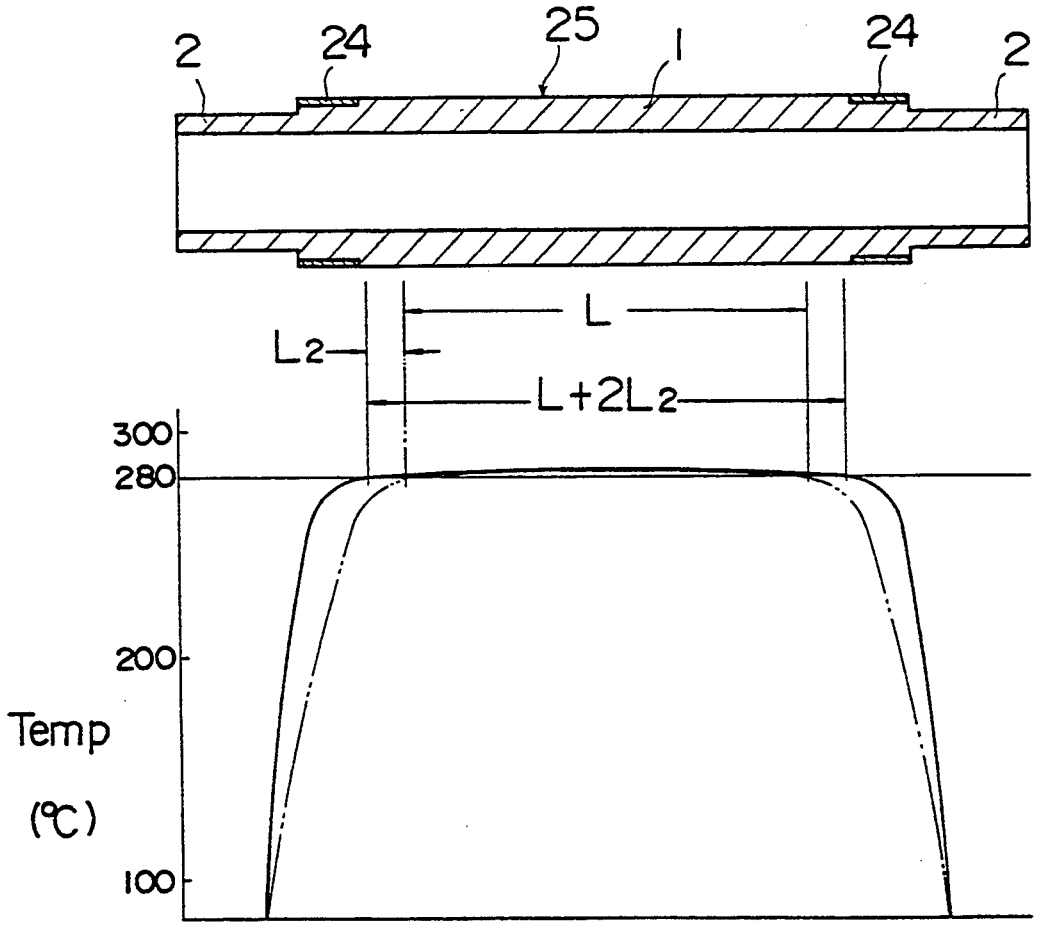
FIG. 40 illustrates the temperature distribution over the surface of the heat roller according to the embodiment of the sixth invention.

FIG. 40 shows the temperature distribution over the surface of the heat roller according to this invention, described above, during energization in comparison with the temperature distribution over the surface of a conventional heat roller provided with no low-resistance portions 24. The solid line is the temperature curve of the heat roller of this invention, and the two-dot chain line is the temperature curve of the conventional heat roller with no low-resistance portions 24. As will be clear from the figure, in the temperature curve of the heat roller of this invention the declining regions corresponding to both ends of the heating portion 1 shorten, while the flat region enlarges. Thus, the usable region increases from L to $L+2L_1$. The reason for this is as follows. Since it is easier for electricity to flow through the low-resistance portions 24 provided on the outer surface near the axial end portions of the heat roller, a larger current flows through the portions 24 than in the other portion, so that increases in the calorific power which are made in the portions 24 compensate for declines in the temperature curve which would otherwise appear at positions corresponding to both ends of the heating portion 1. If the low-resistance portions 24 cause excessive increases in the calorific power, the temperature curve is excessively raised, resulting in a reduction in the flat region. It is therefore necessary to set the resistance of the low-resistance portions 24 within a proper range. For example, it is desirable to set the resistance per unit volume of the low-resistance portions 24 in the range of 95% to 60% of the resistance per unit volume of the other portion of the heat roller.

Figure 41A:
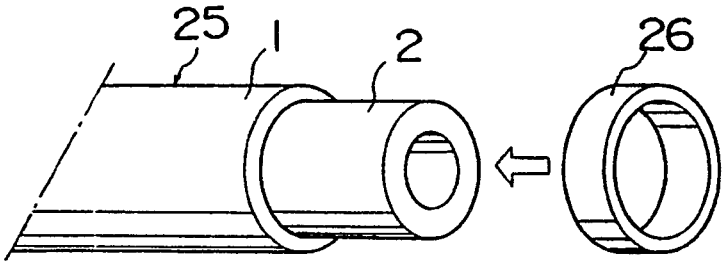
FIG. 41(*a*) is a fragmentary perspective view of another embodiment of the heat roller according to the sixth invention.
Figure 41B:
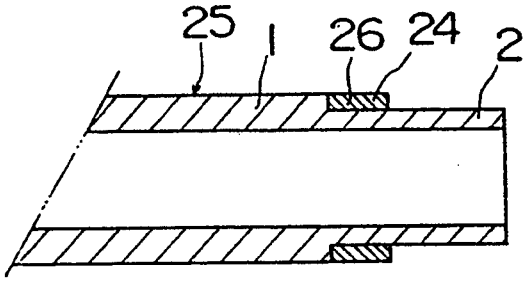

The low-resistance portions 24 may be formed at any positions as long as the portions 24 are provided on the outer surfaces of regions near the axial end portions, which are outside the usable region of the heating portion 1. For example, the low-resistance portions 24 may be provided on the respective outer peripheral portions of the tubular shaft portions 2 projecting from both ends of the heating portion 1, or low-resistance rings 26, which are prepared separately, may be fitted onto the shaft portions 2, as shown in FIGS. 41(*a*) and 41(*b*). In such a case, adhesion between the low-resistance rings 26 and the body portion 25 is important. If the adhesion is no good, electric current will not flow to the low-resistance rings 26 as planned. Accordingly, it is preferable to process both the inner peripheral surfaces of the low-resistance rings 26 and the outer peripheral surfaces of the tubular shaft portions 2 so that the adhesion therebetween is improved.

Figure 42A:
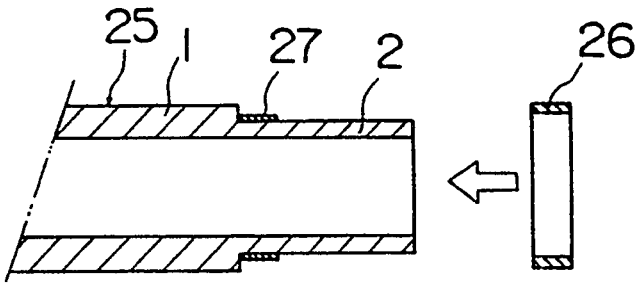
FIG. 42(*a*) is a fragmentary sectional view of still another embodiment of the heat roller according to the sixth invention before it is assembled.
Figure 42B:
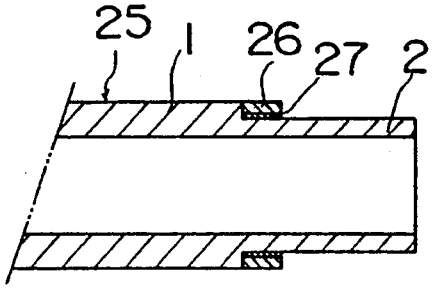

FIG. 42 shows an arrangement in which a soft electrically conductive metal is coated on the surface of a shaft portion 2 onto which a low-resistance ring 26 is to be fitted, by means, for example, of vapor deposition, plating, or coating to provide a good conductor layer 27 for the purpose of improving the adhesion between the low-resistance ring 26 and the body portion 25. The thickness of the good conductor layer 27 is extremely small, and a soft metal, for example, aluminum or copper, is employed as a material therefor. The reason why vapor deposition, plating, or coating is employed as means for providing the good conductor layer 27 is that an electrically conductive metal can be coated in such a manner as to level irregularities in the surface of the molded member by such means and hence electric current can be conducted to the molded member even more effectively. When the low-resistance ring 26 is fitted onto the outer periphery of the shaft portion 2, such a soft metal layer 27 is crushed between the ring 26 and the surface of the shaft portion 2 to fill a gap present between the two members, so that the adhesion between the low-resistance ring 26 and the body portion 25 improves markedly.

Figure 43:
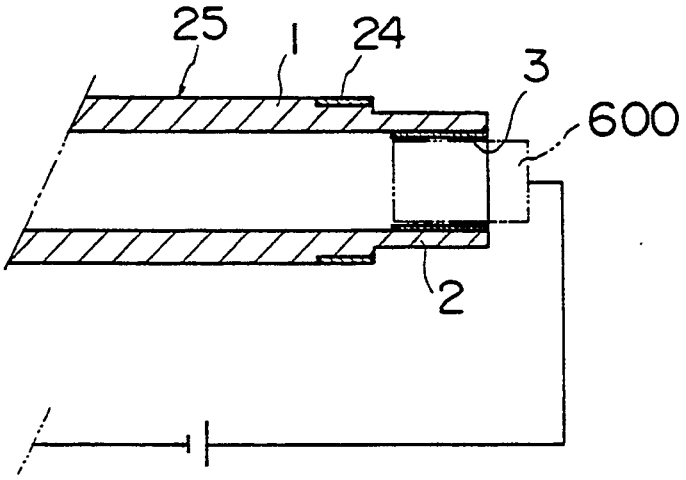
FIG. 43 is a fragmentary sectional view of a further embodiment of the heat roller according to the sixth invention.

FIG. 43 shows an arrangement in which a low-resistance portion 3 is provided on the inner surface of the hollow portion at one axial end of the heat roller which is contacted by a conducting terminal 600 by means, for example, of vapor deposition, plating, or coating so as to provide good electric contact between the inner surface of the hollow portion and the conducting terminal 600 and also to prevent the axial end portion from rising in temperature to a high level in order to minimize the heat load to peripheral members, e.g., a bearing, in addition to the above-described arrangement for heat compensation at the outer surfaces near the axial end portions. The low-resistance portion 3 is provided axially outward of at least the low-resistance portion 24. Like the good conductor layer 27, the low-resistance portion 3 is formed by using a soft metal, for example, aluminum or copper. Although in the illustrated example the length of the low-resistance portion 3 is substantially equal to the length of the shaft portion 2, it may be set properly.

Thus, the heat roller for use in a fixing device according to this invention has a low-resistance portion provided on the outer surface of a region near each axial end of the heat roller, which is outside the usable region of the heating portion, the portion having a lower resistance than that of the other portion, thereby compensating for a declining tendency in the temperature distribution in the vicinity of each axial end portion, and thus enlarging the flat region in the temperature distribution. Accordingly, it is possible to enlarge the usable region of the heating portion for the same length of heat roller and hence possible to obtain a heat roller which is compact in size and yet has a relatively wide usable region.

Figure 44A:
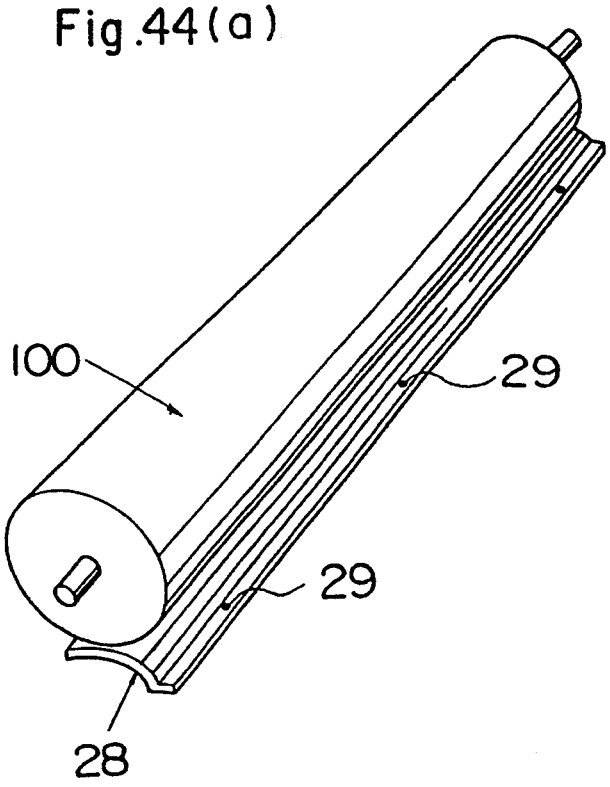
FIG. 44(*a*) is a perspective view of one embodiment of the fixing device according to the seventh invention.
Figure 44B:
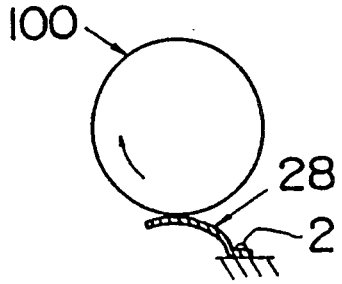
Figure 45A:
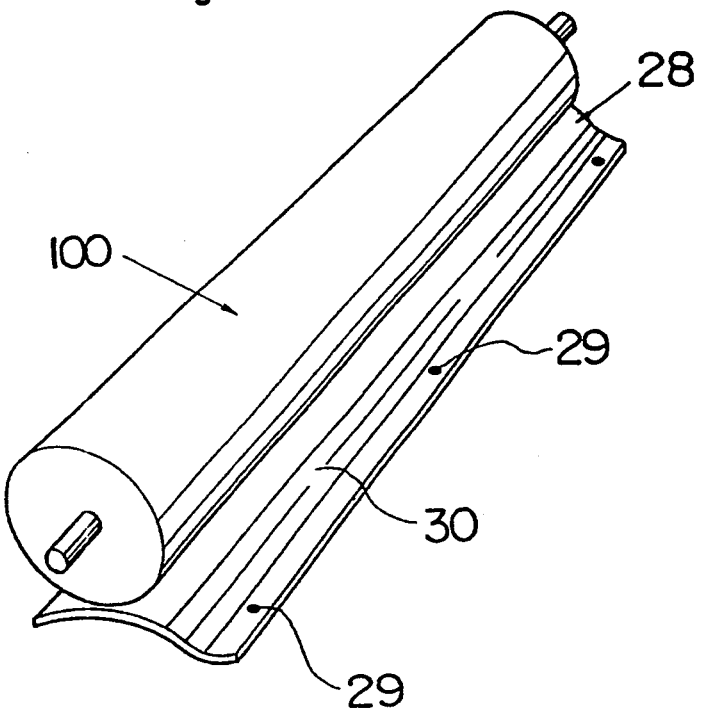
FIG. 45(*a*) is a perspective view of a typical embodiment of the fixing device according to the seventh invention.
Figure 45B:
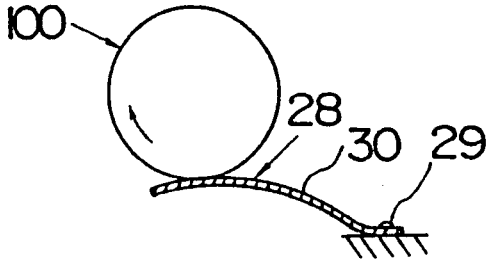
Figure 46:
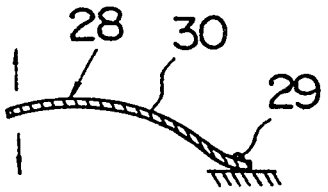
FIG. 46 is a sectional view showing the movement of a plate-shaped resilient member in the fixing device according to the seventh invention.

Next, the seventh invention will be described in detail by way of illustrated embodiments. FIG. 44 is a perspective view of one embodiment of the fixing device according to this invention. The fixing device of this invention comprises a heat roller 100 and a plate-shaped resilient member 28 which is in press contact with the heat roller 100. The heat roller 100 may be either an indirect heating type heat roller in which a tubular heat source is incorporated in a metallic sleeve, or a direct heating type heat roller in which a heating layer formed on the surface of a cylindrical member is energized directly. The feature of this invention resides in that a plate-shaped resilient member that is in press contact with the heat roller surface is employed in place of the conventional rotary press roller. As the plate-shaped resilient member 28, it is possible to use a corrugated member which is secured at one end thereof disposed forwardly as viewed in the paper feed direction by securing means 29, for example, screws, while the other end thereof is defined as a free end. Other types of securing means may also be employed, as a matter of course. FIGS. 45(*a*) and 45(*b*) show a more preferable embodiment of the seventh invention, in which an extended portion 30 having a gently curved surface is formed at the forward end (as viewed in the paper feed direction) of the plate-shaped resilient member 28 and this extended portion 30 is used as a paper guide for feeding recording paper.

The plate-shaped resilient member 28 is formed by using a material which per se has resilience and arranged such that the surface of the free end portion thereof is capable of contacting the surface of the heat roller 100 with an appropriate pressure. The surface of the free end portion of the plate-shaped resilient member 28 is processed uniformly over the entire width thereof so that recording paper passing through the area between the heat roller 100 and the resilient member 28 can be pressed uniformly over the entire width. Examples of materials usable for the plate-shaped resilient member 28 are steels, stainless steels, phosphor bronzes, etc. Since the plate-shaped resilient member 28 contacts the heat roller 100, it is preferable to employ a material therefor which has excellent heat resistance, particularly a material whose resilience will not deteriorate even if it is exposed to a high-temperature environment for a long time. In addition, since recording paper passes through the area between the rotating heat roller 100 and the stationary plate-shaped resilient member 28 and moves slidingly on the surface of the resilient member 28, the surface of the resilient member 28 is required to be excellent in lubricating properties, and it is therefore necessary to minimize the coefficient of friction of the surface of the resilient member 28.

Figure 47A:
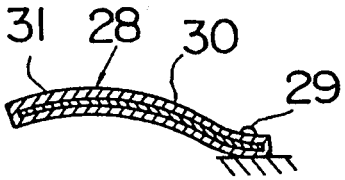
FIG. 47(*a*) and 47(*b*) are sectional views of other examples of the plate-shaped resilient member.
Figure 47B:
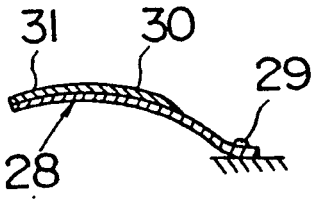

FIG. 47(*a*) shows an arrangement in which a heat-resistant resin material 31 which has excellent lubricating properties is coated on the surface of the plate-shaped resilient member 28 for the purpose of improving the heat resistance and lubricating properties of the surface of the resilient member 28. As the resin material 31, a silicon resin, Teflon (polytetrafluoroethylene), etc. are usable. As a coating method, surface coating, film wrapping method, etc. may be employed. It is not always necessary to coat the whole surface of the plate-shaped resilient member 28, but a heat-resistant resin material 31 may be coated only on a portion of the surface of the resilient member 28 where recording paper passes or only on a portion which comes in direct contact with the heat roller, as shown in FIG. 47(*b*).

Figure 48:
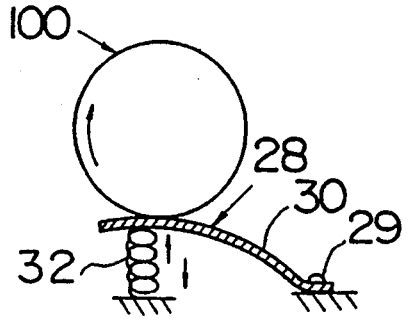
FIG. 48 is a sectional view schematically showing another embodiment of the fixing device according to the seventh invention.

FIG. 48 shows another embodiment of this invention, in which a press spring 32 is disposed under the free end portion of the plate-shaped resilient member 28 to press the resilient member 28 against the surface of the heat roller 100. With this arrangement, since the resilient restoring action of the member 28 is assisted by the press spring 32, the fatigue of the metallic resilient member 28 is reduced, and the adjustment of the level of force with which the resilient member 28 is pressed against the surface of the heat roller 100 can be made by properly setting the pressing force of the spring 32.

Figure 49A:
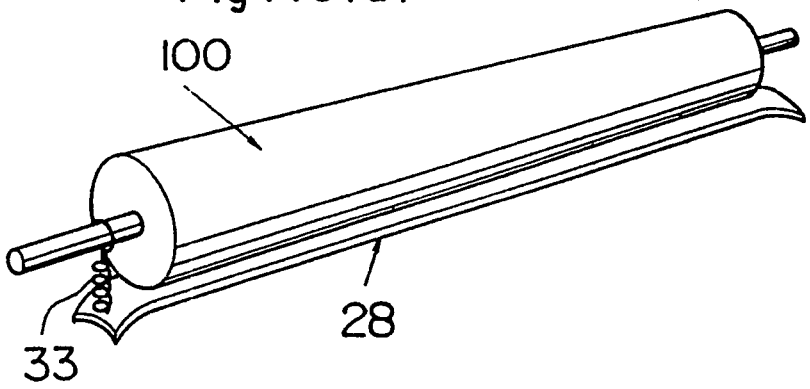
FIG. 49(*a*) is a perspective view of still another embodiment of the fixing device according to the seventh invention.
Figure 49B:
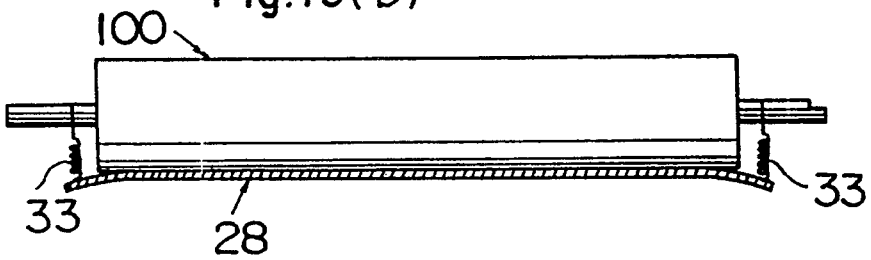
Figure 49C:
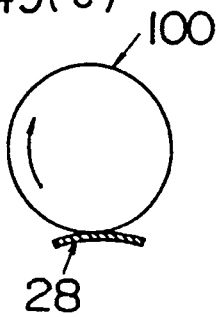
Figure 50:
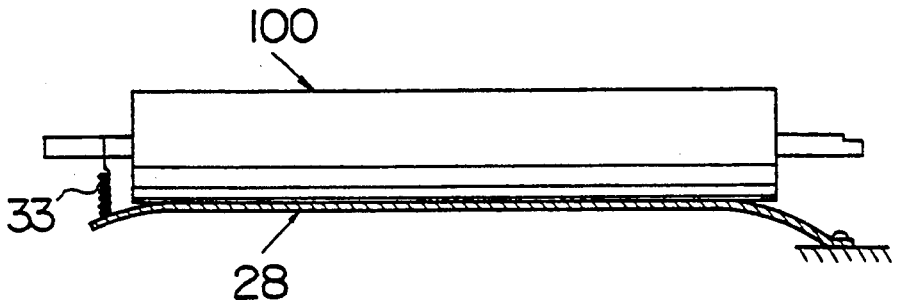
FIG. 50 is a partly-sectioned front view of still another embodiment of the fixing device according to the seventh invention.

FIGS. 49(*a*), 49(*b*) and 49(*c*) show an arrangement in which tension springs 33 are respectively stretched between both longitudinal ends of the plate-shaped resilient member 28 and shaft portions at both ends of the heat roller 100 to pull the resilient member 28 toward the heat roller 100, thereby bringing the resilient member 28 into contact with the surface of the heat roller 100. Although not illustrated, an extended portion which is gently curved forwardly in the paper feed direction may also be formed on the plate-shaped resilient member 28 so as to serve also as a paper guide. FIG. 50 shows an arrangement in which one longitudinal end of the plate-shaped resilient member 28 in the above-described embodiment is fixedly supported, and only the other longitudinal end of the resilient member 28 is pulled by a tension spring 33.

Figure 51:
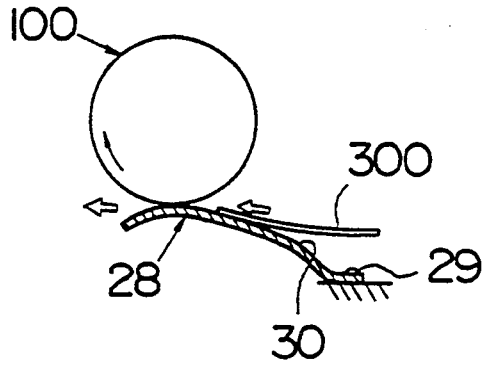
FIGS. 51 and 52 illustrate the way in which the fixing device shown in FIG. 50 is used.
Figure 52:
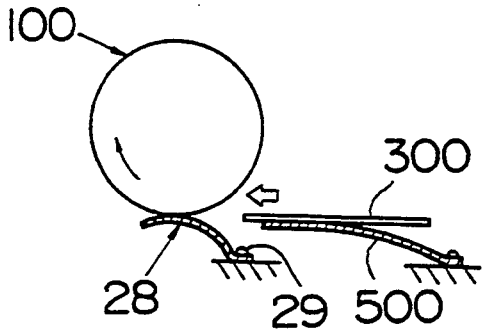
Figure 53:
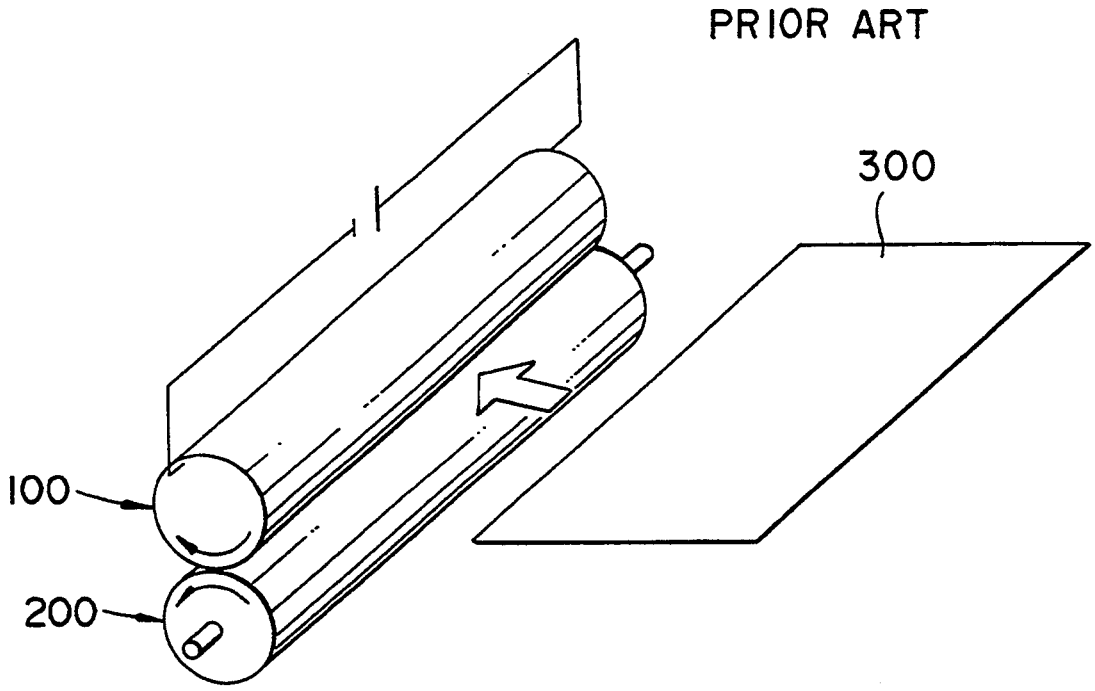
FIG. 53 shows schematically a conventional fixing device.
Figure 54:
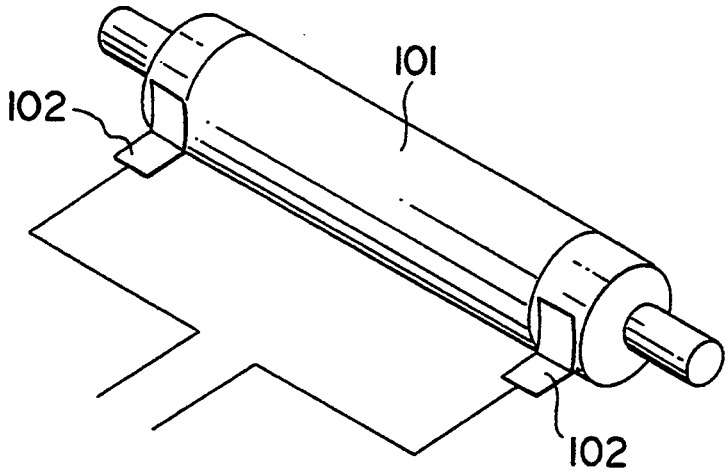
FIG. 54 is a perspective view of one example of conventional heat rollers.
Figure 55:
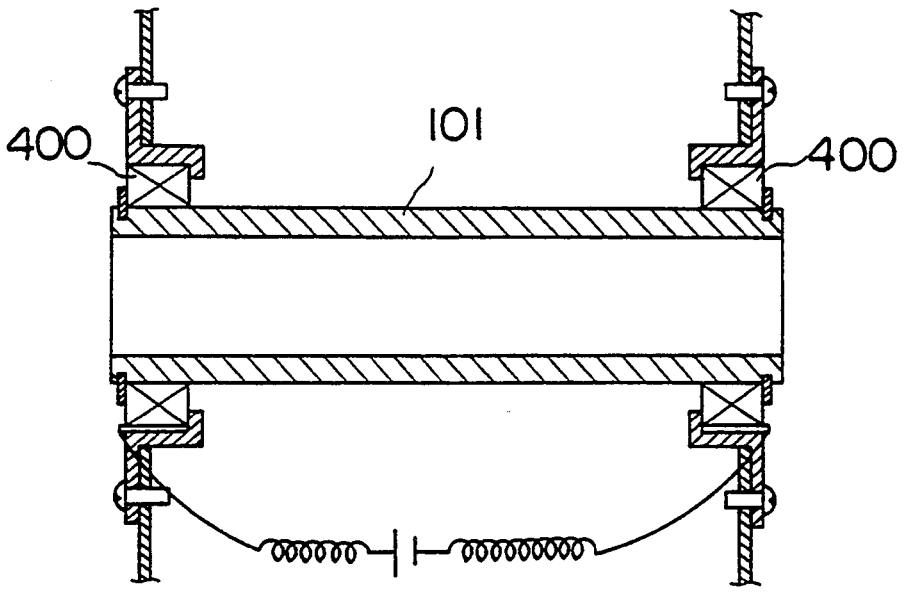
FIG. 55 is sectional view of another example of conventional heat rollers.
Figure 56:
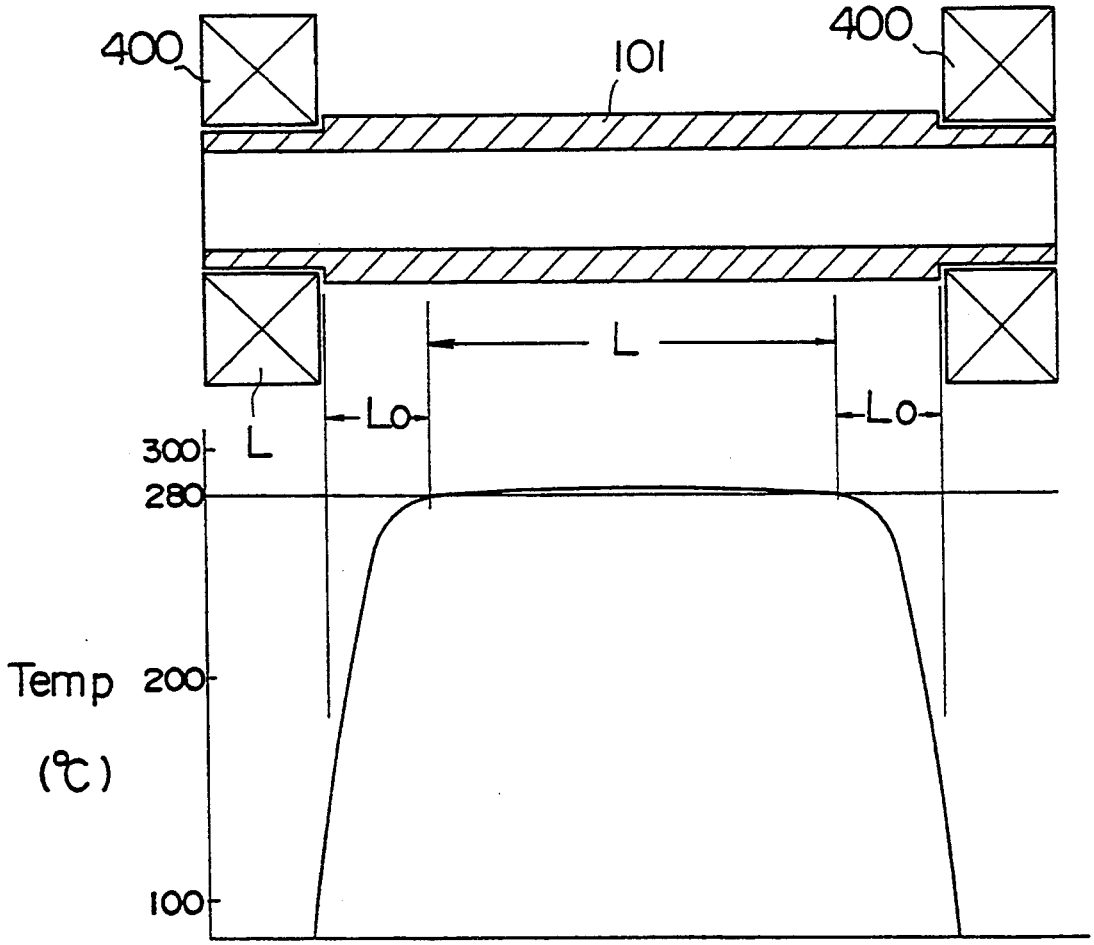
FIG. 56 shows the temperature distribution in the axial direction of the surface of a conventional heat roller.
Figure 57:
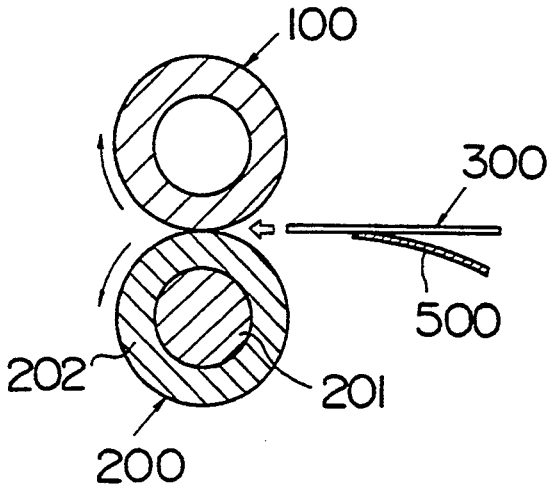
FIG. 57 is a sectional view of one example of conventional fixing devices.
Figure 58A:
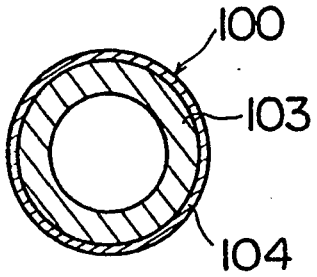
FIG. 58(*a*) is a cross-sectional view of a conventional direct heating type heat roller.
Figure 58B:
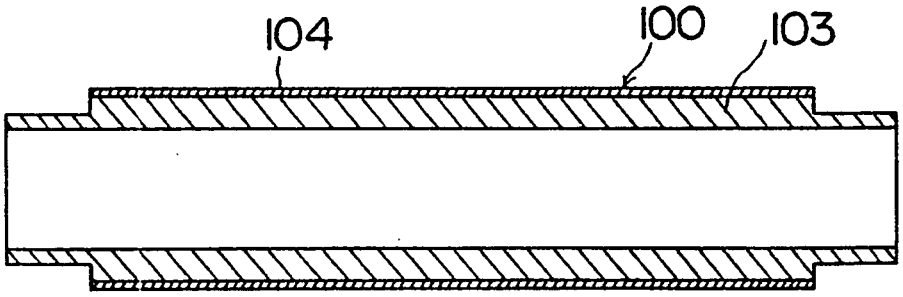
Figure 59:
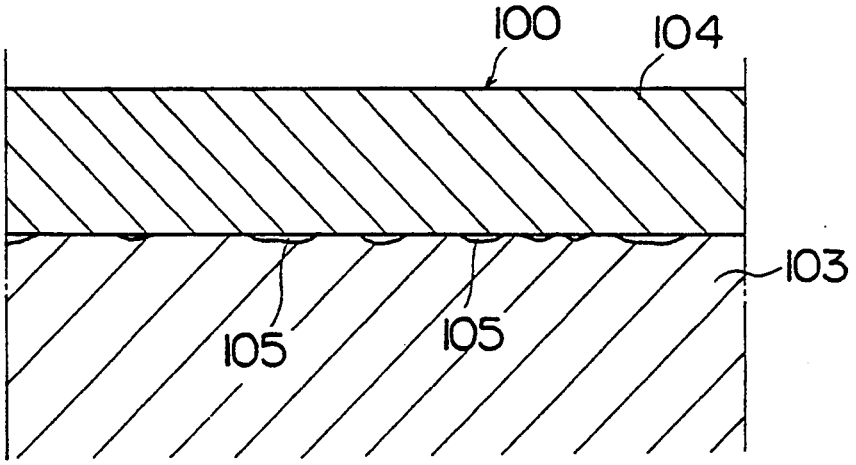
FIG. 59 is an enlarged view of an essential part of the conventional heat roller shown in FIG. 58.

FIG. 51 shows the typical embodiment (shown in FIG. 45) of the fixing device having the above-described arrangement, which is in actual use. More specifically, when a sheet of recording paper 300 having a toner image transferred thereto is fed into the area between the heat roller 100 and the plate-shaped resilient member 28, the recording paper 300 is guided along the extended portion 30 and, while doing so, it is drawn into the area between the heat roller 100 and the resilient member 28. Since the surface of the resilient member 28 has excellent lubricating properties and the resilient member 28 is pressed against the surface of the heat roller 100 with an appropriate level of pressure, the recording paper 300 slides on the surface of the resilient member 28 and, while doing so, it passes compressedly through the area between the resilient member 28 and the heat roller 100, so that the toner image is fixed onto the recording paper 300 during the passing process. FIG. 52 shows the fixing device in actual use, which employs the plate-shaped resilient member 28 with no extended portion. In this case, it is preferable to provide a paper guide 500 or a feed-in roller (not shown) separately in front of the fixing device in order to guide the recording paper 300.

Thus, since the fixing device of this invention employs a plate-shaped resilient member which presses against the surface of the heat roller 100 with an appropriate level of pressure in place of a rotary press roller, the arrangement of the device is markedly simplified, so that it becomes possible to reduce the size of the fixing device and lower the cost thereof and hence it is possible to achieve a reduction in the size and a lowering in the cost of a copying machine, a facsimile or the like in which the fixing device is incorporated. Since the plate-shaped resilient member 28 can serve also as a paper guide by being provided with a portion extending forwardly in the paper feed direction, it becomes unnecessary to provide a paper guide separately, so that it is possible to further reduce the overall size of the apparatus and lower the cost thereof.

Figure 60A:
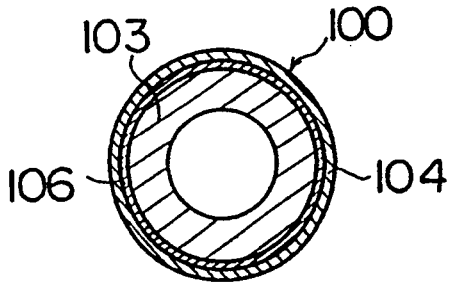
FIG. 60(*a*) is a cross-sectional view of one embodiment of the heat roller according to the eighth invention.
Figure 60B:
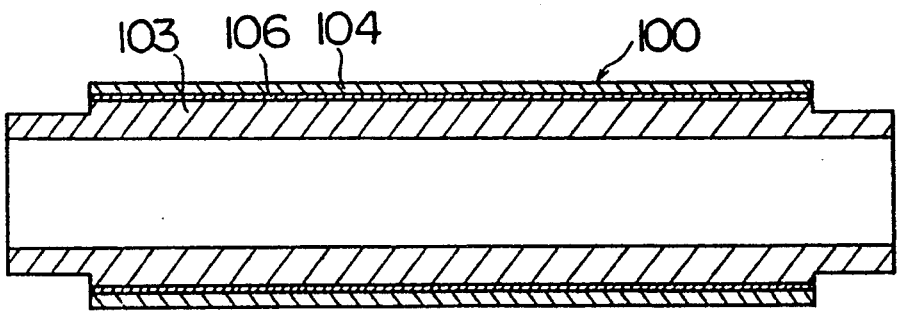

Next, the eighth invention will be described in detail by way of an illustrated embodiment. FIGS. 60(*a*) and 60(*b*) show one embodiment of the heat roller according to this invention, in which the invention is applied to a direct heating type heat roller comprising a heating member made of an electrically conductive ceramic material. The heat roller 100 comprises a roller body 103 which is a heating member made of an electrically conductive ceramic material, a silicone resin material 106 of good thermal conductivity which is coated over the outer surface of the roller body 103, and a resin layer 104 for adhesion which is coated over the silicone resin material 106. As a material for the heating member, a known electrically conductive ceramic material is usable, for example, a material obtained by adding 50% to 60% by weight of Si or FeSi to a ceramic material consisting essentially of aluminosilicate. The adhesion resin layer 104 may be formed by using a synthetic resin material which is excellent in heat resistance and thermal conductivity as well as mold release properties, e.g., polytetrafluoroethylene, silicone rubber, etc. The reason why a silicone resin material is selected as a substance of good thermal conductivity which is interposed between the roller body 103 and the adhesion resin layer 104 is that it is easy to select a material excellent in heat resistance and thermal conductivity from among silicone resin materials and these materials are relatively inexpensive. It is possible to use a silicone resin material having a thermal conductivity of the order of $1.6\times10^{-3}$ cal/cm.sec, for example. It is preferable to use a silicone resin material which is in the form of oil when coated and which is thermoset when the heat roller is heated after it has been coated. It is particularly desirable to use a silicone resin material which is in the form of oil in the temperature range of −50° C. to 150° C. and which is thermoset at a temperature of 150° C. or higher. It is preferable to use such a silicone resin material that the change in state from the state of oil to the state of compound takes place irreversibly and once it is thermoset, the state of compound is maintained even after the heating has been stopped. Such a silicone resin material can be readily coated over the surface of the roller body 103 so as to level irregularities in the surface. In addition, since the material changes to the state of compound after the heat roller has once been heated, there is no likelihood that the silicone resin material will flow out. If the consistency of the silicone resin material exceeds 420, the form fluidity is inferior, so that it is difficult to fit the material to irregularities in the surface of the roller body 103. On the other hand, if the consistency is less than 190, the fluidity is excessively high, so that it is difficult to allow the material to stay on the surface of the roller surface. It is therefore preferable to employ a silicone resin material having a consistency in the range of 190 to 420.

In a case where a silicon resin material is also employed for the resin layer 104, it is necessary to select as a silicone resin material interposed between the roller body 103 and the resin layer 104 a material which does not swell the resin layer 104, that is, which is not absorbed by the resin layer 104.

Figure 61:
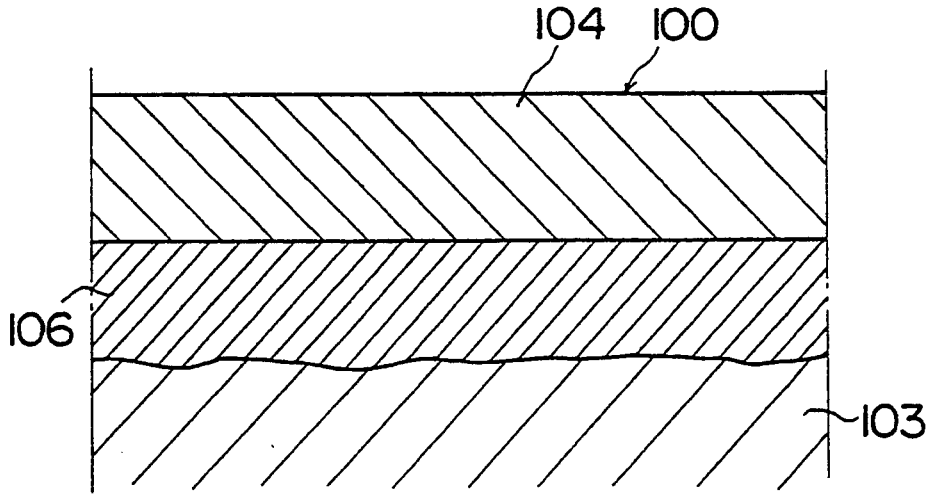
FIG. 61 is an enlarged view of an essential part of the heat roller shown in FIG. 60.

FIG. 61 is a sectional view showing the way in which the silicone resin material 106 and the resin layer 104 are stacked up on the surface of the roller body 103. The silicone resin material 106 fits to irregularities in the surface of the roller body 103 so as to level the surface, thereby completely filling the gap between the roller body 103 and the resin layer 104, and thus completely eliminating minute air gaps, which have heretofore been present between the roller body 103 and the resin layer 104. Thus, according to this invention, the transmission of heat from the roller body 103 to the resin layer 104 can be made uniform over the whole surface of the heat roller 100.

This invention is particularly effective in a case where an electrically conductive ceramic heating member, which cannot get rid of minute irregularities in the surface no matter how it is ground and polished, is employed as a roller body. However, this invention may also be applied to an indirect heating type roller body that employs a metallic sleeve, as a matter of course.

The ninth invention makes it possible to eliminate the need for the silicone resin material 106 interposed between the roller body 103 and the resin layer 104, which is essential for the eighth invention, and yet it exhibits excellent heating response. The feature of the ninth invention resides in that a material for a single resin layer for adhesion which is to be provided on the outer surface of the roller body is selected from among polyimide, polyamide imide, and fluorocarbon resins. Polyimide and polyamide imide have high fluidity, while fluorocarbon resins can be coated by spraying. Therefore, these resin materials are excellent in coating properties and hence capable of being coated on the surface of the roller body in conformity to minute irregularities in the surface. It should be noted that these resin materials are preferably deaerated before being coated. According to the ninth invention, it is possible to reduce the thickness of the resin film formed on the surface of the roller body and hence possible to minimize the temperature difference between the surface of the roller body, which is a heating member, and the surface of the resin film. Accordingly, a heat roller which is excellent in heating response can be provided.

The heat roller of the first invention is arranged such that the heating portion and the shaft portions are integrally molded from the same material in the form of a molded member at least both end portions of which are hollow and that the inner surfaces of the hollow portions at both ends of the molded member are partly or entirely coated with a soft electrically conductive metal by means, for example, of vapor deposition, plating, or coating. Accordingly, it is possible to fit conducting terminals to the respective inner surfaces of the hollow portions at both ends of the heat roller in good contact conditions. In addition, since the heat generation at the two end portions of the heat roller can be suppressed markedly, it becomes possible to use even a bearing member which has relatively low heat resistance. Accordingly, it is possible to use bearing members which have heretofore been difficult to use, for example, bearings made of a synthetic resin material, e.g., polyamide imide.

If the resistance between the axial ends of the molded member before it is coated with an electrically conductive metal is set in the range of 5Ω to 100Ω, it is possible to obtain a calorific power adequate for the heat roller. In addition, if the outer end of at least one of the shaft portions at both ends of the molded member has a cross-sectional configuration containing a straight or curved portion, exclusive of a circular arc, in a part thereof or in its entirety, the connection of the shaft portion with a driving means for rotation is facilitated and ensured.

The heat roller of the second invention is arranged such that the heating portion and the shaft portions are integrally molded from the same material in the form of a molded member at least both end portions of which are hollow, and conducting terminals capable of elastically expanding and contracting in the radial direction are closely fitted into the hollow portions, respectively. Accordingly, the conducting terminals contact the respective inner surfaces of the hollow portions while pressing against the inner surfaces with an appropriate pressure, so that electric power can be satisfactorily supplied to the heating portion made of a ceramic material or the like through the conducting terminals, which are metallic parts. In addition, since the thermal expansion of the conducting terminals caused by heating of the axial end portions to a high temperature can be absorbed by radial deformation of the conducting terminals, there is no possibility of the axial end portions being destroyed.

If each conducting terminal comprises a tubular member with a corrugated outer peripheral surface, which has a metallic core fitted in the center thereof in contact with the inner surface thereof, the core being longer than the tubular member, the thermal expansion is absorbed by deformation of the corrugated tubular member. In addition, since power supply can be effected via the metallic core, connection of feed brushes to the conducting terminals is facilitated.

If a soft electrically conductive metal is coated partly or entirely over the inner surface of the hollow portion provided at each axial end of the heat roller by means, for example, of vapor deposition, plating, or coating, the conducting terminals can be fitted to the respective inner surfaces of the hollow portions in good contact conditions. Moreover, since heat generation at both end portions of the heat roller can be suppressed markedly, it becomes possible to use a bearing member which has relatively low heat resistance. Thus, it is possible to use bearing members, which have heretofore been difficult to use, for example, bearings made of a synthetic resin material, e.g., polyamide imide.

If a conducting terminal is formed by using a low-melting metal in its entirety or in a longitudinal part thereof, when the heat roller excessively rises in temperature, the conducting terminal melts instantaneously to stop the power supply to the heat roller, so that it is possible to completely prevent the occurrence of a fire or other accident and also possible to prevent heat deterioration of the heat roller and peripheral parts. Since this method can be realized at low cost, there will be no rise in the overall cost.

The third invention provides a heat roller for use in a fixing device, which comprises a heating portion and shaft portions projecting from both ends of the heating portion, wherein the heating portion and the shaft portions are integrally molded from the same material in the form of a molded member at least both end portions of which are hollow, and coiled conducting terminals are closely fitted into the hollow end portions, respectively. Accordingly, the coiled conducting terminals contact the respective inner surfaces of the hollow portions while pressing against the inner surfaces with an appropriate pressure, so that electric power can be satisfactorily supplied to the heating portion made of a ceramic material through the conducting terminals, which are metallic parts. In addition, since the thermal expansion of the coiled conducting terminals caused by heating of the axial end portions to a high temperature can be absorbed by radially inward deformation of the conducting terminals, there is no possibility of the axial end portions being destroyed. Since each of the ring portions that constitute a coiled conducting terminal can expand and contract individually, electric contact is surely made between the coiled conducting terminal and the inner surface of the hollow end portion to ensure a good conducting state even if the inner surface is not smooth. In addition, since the free end portion of each coiled conducting terminal can move relatively freely by deformation of the conducting terminal although the other end of the terminal is fitted into the hollow end portion, it is possible to assemble the heat roller, the conducting terminals and the feed brushes without the need for a particularly high degree of accuracy, so that the assembling efficiency improves markedly.

In a case where a metallic core rod which is soft and shorter than the coiled conducting terminals is closely inserted into each conducting terminal and the metallic core rod is closely fitted into the hollow end portion, together with the coiled conducting terminal, the conducting terminal is clamped between the inner surface of the hollow end portion and the metallic core rod, thus enabling the conducting terminal to contact the inner surface of the hollow end portion even more reliably. In addition, since the metallic core rod is soft, it will not excessively press the walls of the shaft portion when the core rod expands thermally.

In a case where a metallic core rod shorter than the coiled conducting terminals is closely inserted into the free end portion of each conducting terminal, or an annular member shorter than the coiled conducting terminals is closely fitted on the outer periphery of the free end portion of each conducting terminal, it becomes easy to connect each conducting terminal with feed brushes.

If a low-melting metal is used to form the entirety or a longitudinal part of a coiled conducting terminal, when the heat roller excessively rises in temperature, the coiled conducting terminal melts instantaneously to stop the power supply to the heat roller and hence it is possible to completely prevent the occurrence of a fire or other accident and also prevent heat deterioration of the heat roller and peripheral parts. Since this method can be realized at low cost, there will be no rise in the overall cost.

The fourth invention is arranged such that a feed brush itself is provided with a bimetallic function, or a current cut-off circuit that utilizes a bimetallic function is provided between a feed brush and a power supply. Accordingly, it is possible to maintain the heat roller at a predetermined temperature with a simple and inexpensive arrangement and also possible to completely prevent deterioration of peripheral parts due to an excessive rise in temperature and eliminate the likelihood of a fire. In particular, in a case where a feed brush itself is provided with a bimetallic function, no additional space for installation is needed to provide a bimetallic function. There is therefore no increase in the size of the heat roller.

If coiled conducting terminals are used to supply electric power to the shaft portions of the heat roller from feed brushes, it is possible to ensure good electric contact between the conducting terminals and the respective inner surfaces of the hollow portions at both axial ends of the heat roller. In addition, the heat roller, the conducting terminals and the feed brushes can be assembled without the need for a particularly high degree of accuracy, so that the assembling efficiency improves markedly.

If an annular member which is shorter than the coiled conducting terminal is fitted onto the end portion of the conducting terminal, it becomes easy to connect together the conducting terminal and feed brushes. In addition, electrical conduction between the coiled conducting terminal and the feed brushes is improved.

In a case where a soft electrically conductive metal is coated on a part or the entirety of the inner surface of each hollow end portion of the molded member by means, for example, of vapor deposition, plating, or coating, to form a low-resistance portion, the greater part of the current passing through each end portion of the molded member passes through the low-resistance portion, and therefore the current passing through the body of the shaft portion is extremely small, so that it is possible to lower the amount of heat generated from the outer and inner peripheries of the shaft portion by a large margin and hence it is possible to reduce the heat load to the bearing and other peripheral parts.

The fifth invention is arranged such that the heating portion and the shaft portions are integrally molded from the same material in the form of a molded member at least both end portions of which are hollow, and the outer peripheries of the shaft portions are supported directly by bearing members made of a heat-resistant and wear-resistant resin material and having no movable parts. Accordingly, no oiling is needed, and a smooth rotational operation of the heat roller can be ensured over a long period of time. Moreover, since the bearing structure is extremely simple, there is an extremely weak possibility of a mechanical failure, and the production cost can be lowered. Thus, it is possible to provide a heat roller suitable for mass-production.

If a soft electrically conductive metal is coated on a part or the entirety of the inner surface of the hollow portion at each end the molded member by means, for example, of vapor deposition, plating, or coating, the conducting terminals can be fitted to the respective inner surfaces of the hollow portions in an even more favorable contact condition. In addition, since the heat generation at both end portions of the heat roller can be suppressed markedly, it becomes possible to use even bearing members which have relatively low heat resistance, and it is possible to further extend the lifetime of the bearing members.

In a case where the resistance between the axial ends of the molded member before it is coated with an electrically conductive metal is set in the range of 5Ω to 100Ω, it is possible to obtain a calorific power adequate for the heat roller. In addition, if the outer end of at least one of the shaft portions at both ends of the molded member has a cross-sectional configuration containing a straight or curved portion, exclusive of a circular arc, in a part thereof or in its entirety, the connection of the shaft portion with a driving means for rotation is facilitated and ensured.

The sixth invention is arranged such that the heating portion and the shaft portions are integrally molded from the same material, and the outer surfaces of regions of the heating portion near the axial end portions, which are outside the usable region of the heating portion, are respectively provided with portions which have a lower resistance than that of the other portion. Accordingly, it is possible to compensate for the descending tendency of the temperature distribution near each axial end portion of the heat roller and thereby enlarge the flat region in the temperature distribution. Thus, it is possible to enlarge the usable region for the same length of heat roller. It is therefore possible to obtain a heat roller which has a compact size and a wide usable region and which is inexpensive and hence possible to achieve a reduction in the size and a lowering in the cost of a copying machine, a facsimile, a laser printer, etc. in which the heat roller is incorporated.

If the electric resistance of the heating portion is set in the range of 5Ω to 100Ω, a calorific power adequate for heat fixing is ensured. If the resistance per unit volume of the low-resistance portions is set in the range of 95% to 60% of the resistance per unit volume of the other portion, the heat compensation can be made moderately near the axial end portions of the heat roller.

In a case where the low-resistance portions and the body portion are made of an electrically conductive ceramic material and these portions are calcined simultaneously, the low-resistance portions and body portion are united together completely. Accordingly, the adhesion at the area of contact between the low-resistance portions and the body portion is improved markedly, so that there is no possibility that electric current will be prevented from flowing into the low-resistance portions. In addition, since the coefficients of thermal expansion of the two different kinds of portion are substantially coincident with each other, there is no possibility that the low-resistance portions or the body portion will be cracked because of the difference in the coefficient of thermal expansion during the process of use.

In a case where low-resistance portions are formed by fitting low-resistance rings which have a lower resistance than that of the body portion onto the shaft portions at both ends of the heat roller and a soft electrically conductive metal is coated on the surfaces of the shaft portions onto which the low-resistance rings are to be fitted, the adhesion between the low-resistance rings and the body portion is improved, so that electric current is allowed to flow into the low-resistance rings even more effectively.

The fixing device of the seventh invention employs a plate-shaped resilient member which presses against the surface of a heat roller with an appropriate pressure in place of the conventional rotary press roller, so that a sheet of recording paper having a toner image transferred thereto is compressedly passed through the area between the heat roller and the plate-shaped resilient member, thereby fixing the toner image. Accordingly, the device structure is simplified, so that it is possible to achieve a reduction in the size of the fixing device and also a lowering in the cost thereof and hence it is possible to reduce the size and cost of a copying machine, a facsimile, etc. in which the fixing device is incorporated.

If the plate-shaped resilient member is formed with a gently curved portion which extends forwardly in the paper feed direction, the extended portion can be employed as a paper guide for recording paper. It is therefore unnecessary to provide a paper guide separately, and it is possible to further reduce the overall size and cost of the device.

If a heat-resistant resin material having excellent lubricating properties is coated on at least a portion of the plate-shaped resilient member which is in contact with the heat roller, recording paper can pass through the area between the two members even more smoothly, and heat deterioration of the plate-shaped resilient member is suppressed, so that the lifetime of the fixing device can be extended.

The heat roller of the eighth invention has a silicone resin material of good thermal conductivity which is interposed between the roller body and the resin layer for adhesion by means, for example, of coating. Accordingly, it is possible to eliminate minute air gaps which would otherwise be formed between minute irregularities in the surface of the roller body and the adhesion resin layer. Thus, it is possible to realize uniform heating over the heat roller surface and improve the heating response and hence it is possible to fix the toner image onto the recording paper excellently. In addition, since this invention enables the heat roller surface to be heated uniformly, it is not necessary to set the heating temperature at a rather high level, and it is therefore possible to reduce the power consumption by a large margin and lower the costs of peripheral parts. Further, it is possible to eliminate welding of the toner to the surface of the heat roller.

If a silicone resin material which is in the form of oil in the temperature range of −50° C. to 150° C. and thermoset at 150° C. or higher is used, it is possible to surely prevent flowing out of the silicone resin material after coating. If a silicone resin material having a consistency in the range of 190 to 420 is used, the silicone resin coating operation is further facilitated.

This invention is particularly effective when an electrically conductive ceramic heating member, which cannot get rid of minute irregularities in the surface no matter how it is ground and polished, is employed as a roller body.

The heat roller of the ninth invention is arranged such that the outer surface of the roller body is provided with a resin layer for adhesion which comprises one material selected from among polyimide, polyamide imide, and fluorocarbon resins. According to the ninth invention, it is possible to reduce the thickness of the resin film formed on the surface of the roller body and hence it is possible to minimize the temperature difference between the surface of the roller body, which is a heating member, and the surface of the resin film. Thus, a heat roller of excellent heating response can be provided.

I claim:

1. A heat roller having a resin layer for adhesion provided on an outer surface of a roller body, comprising a silicone resin material of good thermal conductivity which is in the form of oil in a temperature range of −50° C. to 150° C. and is thermosettable at 150° C. or higher, and which is interposed between said roller body and said resin layer by means of coating.

2. A heat roller according to claim 1, wherein said silicone resin material has a consistency in the range of 190 to 420.

3. A heat roller according to claim 1, wherein said roller body comprises an electrically conductive ceramic heating member.

* * * * *